US005993943A

United States Patent [19]

Bodaghi et al.

[11] Patent Number: 5,993,943

[45] Date of Patent: Nov. 30, 1999

[54] ORIENTED MELT-BLOWN FIBERS, PROCESSES FOR MAKING SUCH FIBERS AND WEBS MADE FROM SUCH FIBERS

[75] Inventors: Hassan Bodaghi, St. Paul; Stanley C. Erickson, Stillwater; Scott M. Purrington, Maplewood; Daniel E. Meyer, Stillwater, all of Minn.; Dennis L. Krueger, Township of Hudson, County of St. Croix, Wis.

[73] Assignee: 3M Innovative Properties Company, St. Paul, Minn.

[21] Appl. No.: 07/914,499

[22] Filed: Jul. 15, 1992

Related U.S. Application Data

[63] Continuation of application No. 07/689,360, Apr. 22, 1991, abandoned, which is a continuation-in-part of application No. 07/608,548, Nov. 2, 1990, abandoned, which is a division of application No. 07/135,693, Dec. 21, 1987, Pat. No. 4,988,560.

[51] Int. Cl.[6] ..... D04H 3/00; D04H 5/04

[52] U.S. Cl. ..... 428/198; 428/362; 428/401; 428/903; 442/340; 442/350; 442/351

[58] Field of Search ..... 442/340, 350, 442/351

[56] References Cited

U.S. PATENT DOCUMENTS

| | | | |
|---|---|---|---|
| 3,016,599 | 1/1962 | Perry | 28/78 |
| 3,502,763 | 3/1970 | Hartmann | 264/210 |
| 3,571,679 | 3/1971 | Van Turnhout | 317/262 |
| 3,704,198 | 11/1972 | Prentice | 161/148 |
| 3,971,373 | 7/1976 | Braun | 128/146.2 |
| 4,001,357 | 1/1977 | Walz et al. | 264/12 |
| 4,041,203 | 8/1977 | Brock et al. | 428/157 |
| 4,048,364 | 9/1977 | Harding | 428/113 |
| 4,083,913 | 4/1978 | Marshall | 264/121 |
| 4,118,531 | 10/1978 | Hauser | 428/224 |
| 4,196,245 | 4/1980 | Kitson et al. | 428/198 |
| 4,215,682 | 8/1980 | Kubik et al. | 128/205.29 |
| 4,217,387 | 8/1980 | Viezee et al. | 428/288 |
| 4,302,495 | 11/1981 | Marra | 428/110 |
| 4,340,563 | 7/1982 | Appel et al. | 264/518 |
| 4,350,482 | 9/1982 | Alexandrov et al. | 425/83.1 |
| 4,375,718 | 3/1983 | Wadsworth et al. | 29/592 E |
| 4,429,001 | 1/1984 | Kolpin et al. | 428/283 |
| 4,434,204 | 2/1984 | Hartmann et al. | 428/198 |
| 4,468,428 | 8/1984 | Early et al. | 428/221 |
| 4,496,508 | 1/1985 | Hartmann et al. | 264/167 |

(List continued on next page.)

FOREIGN PATENT DOCUMENTS

| | | | |
|---|---|---|---|
| 0 190 012 | 8/1986 | European Pat. Off. | D04H 1/56 |
| 0 322 136 | 6/1989 | European Pat. Off. | D04H 1/56 |
| 3542660 A1 | 4/1987 | Germany | D04H 3/05 |

OTHER PUBLICATIONS

Wente, Van A., "Superfine Thermoplastic Fibers" in *Industrial Engineering Chemistry*, vol. 48, p. 1342 et seq. (1956).

Wente, Van A.; Boone, C.D.; and Fluharty, E.L., Report No. 4364 Naval Research Laboratories, May 25, 1954,, "Manufacture of Superfine Organic Fibers".

Buntin, Rober A. and Lohkamp, Dwight D., "Melt–Blowing—A One–Step Process For New Non–Woven Products", TAPPI, vol. 56, No. 4, Apr., 1973.

McCulloch, W. John & VanBrederode, Robert A., "Technical Developments in the Melt–Blowing Process And Its Applications in Absorbent Products", presented at Insight '81, copyright Marketing/Technology Service, Inc., of Kalamazoo, MI.

Alexander, L.E., *X–Ray Diffraction Methods In Polymer Science*, Chapter 4, entitled "Preferred Orientation in Polymers", published by R.E. Krieger Publishing Co., New York, 1979, see particularly, p. 241, Equation 4–21.

*Primary Examiner*—Elizabeth M. Cole

*Attorney, Agent, or Firm*—Gary L. Griswold; Robert W. Sprague; William J. Bond

[57] ABSTRACT

Oriented microfibers and processes for making them are disclosed, together with blends of such microfibers with other fibers such as crimped staple fibers and non-oriented microfibers.

10 Claims, 13 Drawing Sheets

U.S. PATENT DOCUMENTS

| | | | |
|---|---|---|---|
| 4,533,376 | 8/1985 | Muschelknautz et al. | 65/5 |
| 4,536,361 | 8/1985 | Torobin | 264/167 |
| 4,547,420 | 10/1985 | Krueger et al. | 428/229 |
| 4,587,154 | 5/1986 | Hotchkiss et al. | 428/195 |
| 4,588,537 | 5/1986 | Klaase | 264/22 |
| 4,588,635 | 5/1986 | Donovan | 428/288 |
| 4,592,815 | 6/1986 | Nakao | 204/165 |
| 4,622,259 | 11/1986 | McAmish et al. | 428/171 |
| 4,642,262 | 2/1987 | Piotrowski et al. | 428/296 |
| 4,676,815 | 6/1987 | Wagner et al. | 65/16 |
| 4,784,892 | 11/1988 | Storey et al. | 428/198 |
| 4,828,469 | 5/1989 | Right | 425/7 |
| 4,847,035 | 7/1989 | Mente et al. | 264/555 |
| 4,957,795 | 9/1990 | Riedel | 428/76 |

ORIENTED MELT-BLOWN FIBERS, PROCESSES FOR MAKING SUCH FIBERS AND WEBS MADE FROM SUCH FIBERS

CROSS REFERENCE TO RELATED APPLICATIONS

This is a continuation of application Ser. No. 07/689,360 filed Apr. 22, 1991, abandoned, which is a continuation-in-part of U.S. Ser. No. 608,548, filed Nov. 2, 1990, abandoned, which is a divisional of U.S. Ser. No. 135,693, filed Dec. 21, 1987, now U.S. Pat. No. 4,988,560.

TECHNICAL FIELD

The present invention is directed to melt-blown fibrous webs, i.e., webs prepared by extruding molten fiber-forming material through orifices in a die into a high-velocity gaseous stream which impacts the extruded material and attenuates it into fibers, often of microfiber size averaging on the order of 10 micrometers or less.

BACKGROUND ART

During the over twenty-year period that melt-blown fibers have come into wide commercial use, for uses such as filtration, battery electrode separation and insulation, there has been a recognized need for fibers of extremely small diameters and webs of good tensile strength. However, there has always been a recognition that the tensile strength of melt-blown fibers was low, e.g., lower than that of fibers prepared in conventional melt-spinning processes (see the article "Melt-Blowing—A One-Step Web Process For New Nonwoven Products," by Robert R. Buntin and Dwight D. Lohkcamp, Volume 56, No. 4, April 1973, Tappi, Page 75, paragraph bridging columns 2 and 3). At least as late as 1981, the art generally doubted "that melt-blown webs, per se, will ever possess the strengths associated with conventional nonwoven webs produced by melt spinning in which fiber attenuation occurs below the polymer melting point bringing about crystalline orientation with resultant high fiber strength" (see the paper "Technical Developments In The Melt-Blowing Process And Its Applications In Absorbent Products" by Dr. W. John McCulloch and Dr. Robert A. VanBrederode presented at Insight '81, copyright Marketing/TechnoLogy Service, Inc., of Kalamazoo, Mich., page 18, under the heading "Strength").

The low strength of melt-blown fibers limited the utility of the fibers, and as a result there have been various attempts to combat this low strength. One such effort is taught in Prentice, U.S. Pat. No. 3,704,198, where a melt-blown web is "fuse-bonded," as by calendering or point-bonding, at least a portion of the web. Although web strength can be improved somewhat by calendering, fiber strength is left unaffected, and overall strength is still less than desired.

Other prior workers have suggested blending high-strength bicomponent fibers into melt-blown fibers prior to collection of the web, or lamination of the melt-blown web to a high strength substrate such as a spunbond web (see U.S. Pat. Nos. 4,041,203, 4,302,495 and 4,196,245). Such steps add costs and dilute the microfiber nature of the web, and are not satisfactory for many purposes.

With regard to fiber diameter, there is a recognized need for fibers of uniformly small diameters and extremely high aspect ratios, as discussed, for example in Hauser U.S. Pat. No. 4,118,531 (col. 5) and Kubik et al. U.S. Pat. No. 4,215,682 (cols. 5 and 6). However, as recognized by Hauser, despite the ability to get melt-blown fibers with very small average fiber diameters, the fiber size distribution is quite large, with fibers in the 6 to 8 micrometer range present for use with fibers of an average fiber diameter of 1 to 2 micrometers (Examples 5–7). Problems are also present in eliminating larger diameter "shot", discussed in the above Buntin et al. article, page 74, first paragraph of col. 2. Shot is formed when the fibers break in the turbulence from the impinging air of the melt-blown process. Buntin indicates that shot is unavoidable and of a diameter greater than that of the fibers.

McAmish et al, U.S. Pat. No. 4,622,259, is directed to melt-blown fibrous webs especially suitable for use as medical fabrics and said to have improved strength. These webs are prepared by introducing secondary air at high velocity at a point near where fiber-forming material is extruded from the melt-blowing die. As seen best in FIG. 2 of the patent, the secondary air is introduced from each side of the stream of melt-blown fibers that leaves the melt-blowing die, the secondary air being introduced on paths generally perpendicular to the stream of fibers. The secondary air merges with the primary air that impacted on the fiber-forming material and formed the fibers, and the secondary air is turned to travel more in a direction parallel to the path of the fibers. The merged primary and secondary air then carries the fibers to a collector. The patent states that, by the use of such secondary air, fibers are formed that are longer than those formed by a conventional melt-blowing process and which exhibit less autogeneous bonding upon fiber collection; with the latter property, the patent states it has been noted that the individual fiber strength is higher. Strength is indicated to be dependent on the degree of molecular orientation, and it is stated (column 9, lines 21–27) that the high velocity secondary air employed in the present process is instrumental in increasing the time and distance over which the fibers are attenuated. The cooling effect of the secondary air enhances the probability that the molecular orientation of the fibers is not excessively relaxed on the deceleration of the fibers as they are collected on the screen. Fabrics are formed from the collected web by embossing the webs or adding a chemical binder to the web, and the fabrics are reported to have higher strengths, e.g., a minimum grab tensile strength-to-weight ratio greater than 0.8 N per gram per square meter, and a minimum Elmendorf tear strength-to-weight ratio greater than 0.04 N per gram per square meter. The fibers are also reported to have a diameter of 7 micrometers or less. However, there is no indication that the process yields fibers of a narrow fiber diameter distribution or fibers with average diameters of less than 2.0 micrometers, substantially continuous fibers or fiber webs substantially free of shot.

DISCLOSURE OF INVENTION

The present invention provides new melt-blown fibers and fibrous webs of greatly improved fiber diameter size distribution, average fiber diameter, fiber and web strength, and low-shot levels. The new melt-blown fibers have much greater orientation and crystallinity than previous melt-blown fibers, as a result of preparation by a new method which, in brief summary, comprises extruding fiber-forming material to a metering means and then through to the orifices of a die into a controlled high-velocity gaseous stream where the extruded material is rapidly attenuated into fibers; directing the attenuated fibers and gaseous stream into a first open end, i.e., the entrance end, of a tubular chamber disposed near the die and extending in a direction parallel to the path of the attenuated fibers as they leave the die; introducing air with both radial and axial components into the tubular chamber such that the air blowing along the axis of the chamber is at a velocity sufficient to maintain the fibers under tension during travel through the chamber, and preferably introducing air perpendicular to the longitudinal axis of the chamber along substantially the entire length of the chamber; optionally directing the attenuated fibers into a second tubular chamber where quenched fibers are further drawn by air blowing along the axis of the chamber; and collecting the fibers after they leave the opposite, or exit end, of the last tubular chamber.

Generally, the tubular chamber is a thin wide box-like chamber (generally somewhat wider than the width of the melt-blowing die). Orienting air is generally introduced into the chamber at an angle to the path of the extruded fibers, but travels around a curved surface at the first open end of the chamber. By the Coanda effect, the orienting air turns around the curved surface in a laminar, non-turbulent manner, thereby assuming the path traveled by the extruded fibers and merging with the primary air in which the fibers are entrained. The amount of the radial flow component of the air available for intersecting and directing the extruded fibers into the chamber can be adjusted by varying the radius of the coanda surface. Larger and more gradual areas of radial flow are obtained with larger radii. A large radial flow region acts to provide more directioning of the fibers into the axial centerline of the chamber. Smaller radii Coanda surfaces decrease the relative amount of axial flow component of the air available for intersecting and guiding the fibers into the axial centerline of the chamber. However, the greater axial flow components from smaller radii Coanda surfaces tend to increase the draw force of the air on the fibers in the chamber. Generally, the Coanda surfaces can be used having an infinite range of radii. However, as the radii decreases to nil, the angle will be to sharp, and the air will tend to separate from the surface. Radii have been used as low as ⅛ in and are generally 0.5 to 1.5 in.

Preferably, a second perpendicular cooling stream of air is introduced along the length of the chamber. This air is introduced into the chamber in a diffuse manner preferably thru two opposing walls of the chamber facing the plane of fibers exiting from the die. This is done, for example, by having at least a portion of the sidewalls made of a porous glass composite. This perpendicular air further guides the fibers into the center of the chamber while preventing stray fibers from sticking to the chamber walls. The fibers are drawn into the chamber in an orderly compact stream and remain in that compact stream through the complete chamber. If only one chamber is used, preferably, the described tubular chamber is flared outwardly around the circumference of its exit end, which has been found to better provide isotropic properties in the collected or finished web.

The orienting air and perpendicular cooling air generally have a cooling effect on the fibers (the orienting air flows can be, but usually are not, heated, but are ambient air at a temperature less than about 35° C.; in some circumstances, it may be useful to cool the orienting air or perpendicular air below ambient temperature before it is introduced into the orienting chamber.) The cooling effect is generally desirable since it accelerates solidification of the fibers under orienting conditions, strengthening the fibers. Further, the pulling effect of the orienting air as it travels through the orienting chamber provides a tension on the solidifying fibers that tends to cause them to crystallize.

A secondary tubular chamber can be used to impart further orientation to the fibers exiting the primary tubular chamber. As the fibers are normally quenched at this point, higher air pressure can be employed to impart a higher tension on the fibers to further enhance orientation. The need for the diffuse perpendicular air flow is less due to the low tack nature of the fibers in this chamber, however, perpendicular air can be used.

The significant increase in molecular orientation and crystallinity of the fibers of the invention over conventional melt-blown fibers is illustrated by reference to FIGS. 4, 7, 8, 10 and 11, which show WAXS (wide-angle x-ray scattering) photographs of fibers that, respectively, are oriented fibers of the invention (A photo) and are non-oriented conventional fibers of the prior art (B photo). The ring-like nature of the light areas in the B photos signifies that the pictured fibers of the invention are highly crystalline, and the interruption of the rings means that there is significant crystalline orientation.

DETAILED DESCRIPTION

Figure 1:
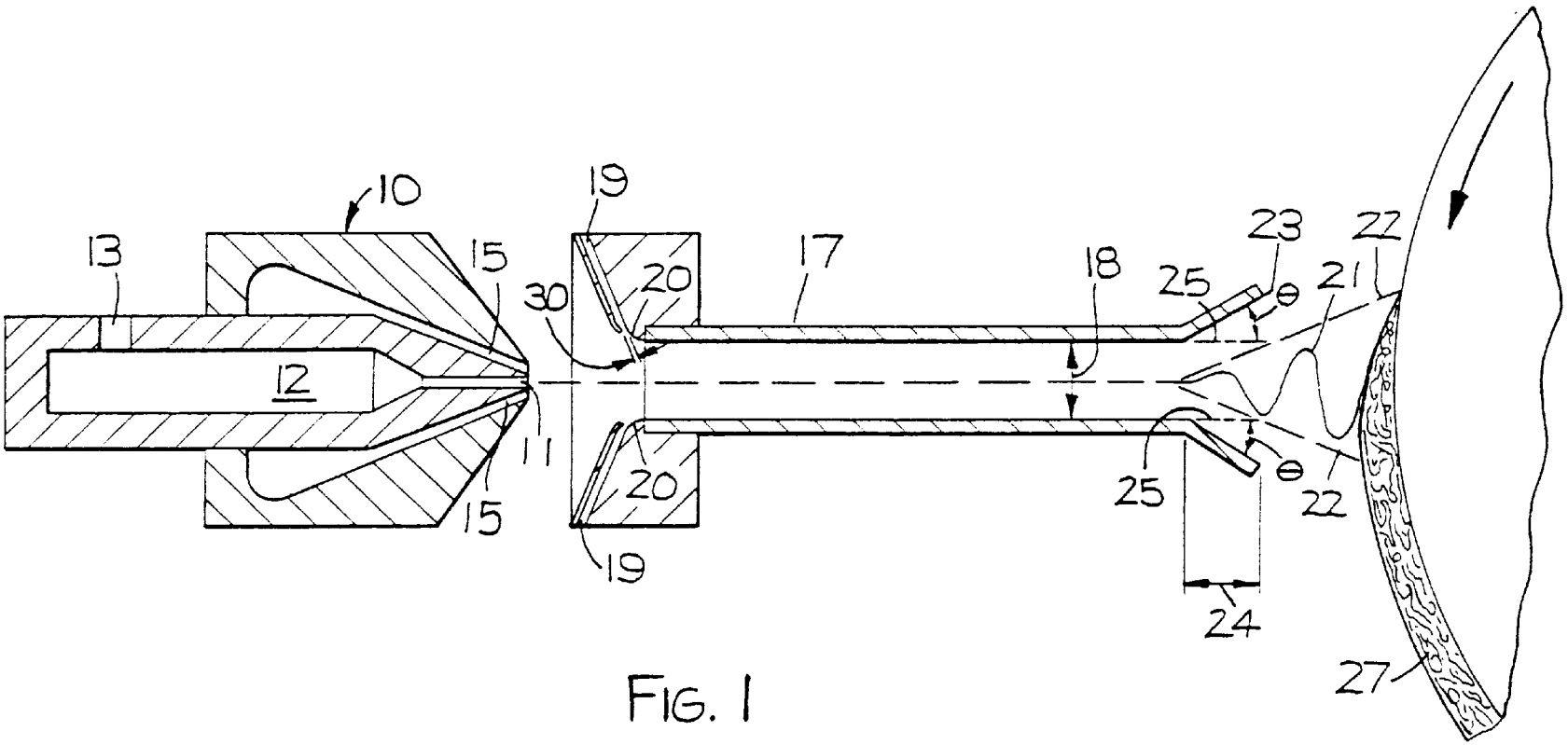
FIGS. 1 and 2A and 2B are a side view and perspective views, respectively, of different apparatuses useful for carrying out methods of the invention to prepare fabrics of the invention.

A representative apparatus useful for preparing blown fibers or a blown-fiber web of the invention is shown schematically in FIG. 1. Part of the apparatus, which forms the blown fibers, can be as described in Wente, Van A., "superfine Thermoplastic Fibers" in *Industrial Engineering Chemistry*, Vol. 48, page 1342 et seq. (1956), or in Report No. 4364 of the Naval Research Laboratories, published May 25, 1954, entitled "Manufacture of Superfine Organic Fibers," by Wente, V. A.; Boone, C. D.; and Fluharty, E. L. This portion of the illustrated apparatus comprises a die 10 which has a set of aligned side-by-side parallel die orifices 11, one of which is seen in the sectional view through the die. The orifices 11 open from the central die cavity 12.

Fiber-forming material is introduced into the die cavity 12 through an opening 13 from an extruder (not illustrated). Air gaps 15, disposed on either side of the row of orifices 11, convey heated air at a very high velocity. This air, called the primary air, impacts onto the extruded fiber-forming material, and rapidly draws out and attenuates the extruded material into a mass of fibers. The primary air is generally heated and supplied at substantially identical pressures to both air gaps 15. The air is also preferably filtered to prevent dirt or dust from interfering with uniform fiber formation. The air temperature is maintained generally at a temperature greater than that of the melt polymer in the die orifices. Preferably, the air is at least 5° C. above the temperature of the melt. Temperatures below this range can cause excessive quenching of the polymer as it exits the die, making orientation in the chambers difficult. Too high a temperature can excessively degrade the polymer or increase the tendency for fiber breakage.

From the melt-blowing die 10, the fibers travel to a primary tubular orienting chamber 17. "Tubular" is used in this specification to mean any axially elongated structure having open ends at each axially opposed end, with walls surrounding the axis. Generally, the chamber is a rather thin, wide, box-like chamber, having a width somewhat greater than the width of the die 10, and a height (18 in FIG. 1) sufficient for the orienting air to flow smoothly through the chamber without undue loss of velocity, and for fibrous material extruded from the die to travel through the chamber without contacting the walls of the chamber. Too large a height would require unduly large volumes of air to maintain a tension-applying air velocity. Good results for a solid walled chamber 17 have been obtained with a height of about 10 millimeters or more, and we have found no need for a height greater than about 25 millimeters.

The walls 26 along the width of the chamber 17 can be made of air-permeable or porous material. A secondary cooling diffuse airstream can then be introduced along the width of the chamber. This airflow serves the function of increasing the polymer solidification and/or crystallization rate in the quenching chamber 17. This secondary cooling air also helps keep the fibers in the center of the chamber 17 and off the walls 26. However, the air pressure of this cooling airstream should not be so high as to cause turbulence in the chamber. Generally, a pressure of from 2 to 15 PSI has been found acceptable.

Orienting air is introduced into the orienting chamber 17 through the orifices 19 arranged near the first open end of the chamber where fibers entrained in the primary air from the die enter the chamber. Orienting air is preferably introduced from both sides of the chamber (i.e., from opposite sides of the stream of fibers entering the chamber) around curved surfaces 20, which may be called coanda surfaces. A larger radius Coanda surface is preferred for the orienting chamber 17 when the polymer used is less crystalline or has a slow crystallization rate. Further, with low crystalline polymers, preferably the air exits from an orifice adjacent the Coanda surface at an angle to a line perpendicular to the axial centerline of the chamber. At an angle of zero, the air would exit the orifice parallel to the axial centerline. Generally, the orienting air exit angle was varied from 0 to 90 degrees, although higher angles are feasible. An air exit angle of 30 to 60 degrees was found to be generally preferred. A lower orienting air exit angle is acceptable if a quenching chamber is used prior to the orienting chamber or a highly crystalline polymer is melt blown.

The orienting air introduced into the chamber bends as it exits the orifice and travels around the Coanda surfaces to yield a predominately axial flow along the longitudinal axis of the chamber. The travel of the air is quite uniform and rapid, and it draws into the chamber, in a uniform manner, the fibers extruded from the melt-blowing die 10. Whereas fibers exiting from a melt-blown die typically oscillate in a rather wide pattern soon after they leave the die, the fibers exiting from the melt-blowing die in the method of the invention tend to pass uniformly in a surprising planar-like distribution into the center of the chamber and travel lengthwise through the chamber without significant oscillation.

After the fibers exit the chamber 17, they typically exhibit oscillating movement as represented by the oscillating line 21 and by the dotted lines 22, which represent the general outlines of the stream of fibers. This oscillation results from the expansion or flaring at the chamber 17 exit. This oscillation, however, does not result in significant fiber breakage as it would tend to cause if present closely adjacent to the melt-blown die orifice. The orienting chamber significantly strengthens the fiber so that post-chamber oscillation, with the resulting increase in peak stress that the fibers are exposed to, is more readily endured without fiber breakage.

As shown in FIG. 1, for the single orienting chamber 17 embodiment, the chamber 17 is preferably flared at its exit end 23. This flaring has been found to cause the fibers to assume a more randomized or isotropic arrangement within the fiber stream, however, without fiber breakage. For example, a collected web of fibers of the invention passed through a chamber which does not have a flared exit tends to have a machine-direction fiber pattern (i.e., more fibers tend to be aligned in a direction parallel to the direction of movement of the collector than are aligned transverse to that direction). On the other hand, webs of fibers collected from a chamber with a flared exit are more closely balanced in machine and transverse orientation. The flaring can occur both in its height and width dimensions, i.e., in both the axis or plane of the drawing and in the plane perpendicular to the page of the drawings. More typically, the flaring occurs only in the axis in the plane of the drawing, i.e., in the large-area sides or walls on opposite sides of the stream of fibers passing through the chamber. Flaring at an angle (the angle 0) between a broken line 25 parallel to the longitudinal axis of the chamber and the flared side of the chamber between about 4 and 7° is believed ideal to achieve smooth isotropic deposit of fibers. The length 24 of the portion of the chamber over which flaring occurs (which may be called the randomizing portion of the chamber) depends on the velocity of the orienting air and the diameter of fibers being produced. At lower velocities, and at smaller fiber diameters, shorter lengths are used. Flaring lengths between 25 and 75 centimeters have proven useful.

The orienting air enters the orienting chamber 17 at a high velocity, sufficient to hold the fibers under tension as they travel lengthwise through the chamber. Planar continuous travel through the chamber is an indication that the fibers are continuous and under stressline tension. The needed velocity of the air for orientation, which is determined by the pressure with which air is introduced into the orienting chamber and the dimensions of the orifices or gaps 19, varies with the kind of fiber-forming material being used and the diameter of the fibers. For most situations, velocities corresponding to pressures of about 70 PSI (approximately 500 kPa) with a gap width for the orifice 19 (the dimension 30 in FIG. 1) of 0.005 inch (0.013 cm), have been found optimum to assure adequate tension. However, pressures as low as 20 to 30 PSI (140 to 200 kPa) have been used with some polymers, such as nylon 66, with the stated gap width. If chamber 17 is used primarily as a quenching chamber, pressures as low as 5 PSI can be used for the orienting air.

Surprisingly, most fibers can travel through the chamber a long distance without contacting either the top or bottom surface of the chamber. However, in the first chamber (17 or 37) preferably a secondary cooling airflow is introduced perpendicular to the fibers in a diffuse manner through the chamber sidewalls. The secondary cooling airflow is preferred with polymers having a low crystallization rate, as they have an increased tack and, hence, a tendency for stray fibers to adhere to the chamber sidewalls. The cooling airflow also increases fiber strength by its quenching action, decreasing the likelihood of any fiber breakage before, in or after the first chamber (17 or 37).

The chambers are generally at least about 40 centimeters long (shorter chambers can be used at lower production rates or where the first chamber functions primarily as an orienting chamber) and preferably is at least 100 centimeters long to achieve desired orientation and desired mechanical properties in the fibers. With shorter chamber lengths, faster air velocities can be used to still achieve fiber orientation. The entrance end of the first chamber is generally within 3–10 centimeters of the die, and as previously indicated, despite the disruptive turbulence conventionally present near the exit of a melt-blowing die, the fibers are drawn into the chamber in an organized manner.

After exiting from the orienting or last chamber (17 or 38), the solidified fibers are decelerating, and, in the course of that deceleration, they are collected on the collector 26 as a web 27 as a possibly misdirecting mass of entangled fibers. The collector may take the form of a finely perforated cylindrical screen or drum, a rotating mandrel, or a moving belt. Gas-withdrawal apparatus may be positioned behind the collector to assist in deposition of fand removal of gas.

The collected web of fibers can be removed from the collector and wound in a storage roll, preferably with a liner separating adjacent windings on the roll. At the time of fiber collection and web formation, the fibers are totally solidified and oriented. These two features tend to cause the fibers to have a high modulus, and it is difficult to make high-modulus fibers decelerate and entangle sufficiently to form a handleable coherent web. Webs comprising only oriented melt-blown fibers may not have the coherency of a collected web of conventional melt-blown fibers. For that reason, the collected web of fibers is often fed directly to apparatus for forming an integral handleable web, e.g., by bonding the fibers together as by calendering the web uniformly in areas or points (generally in an area of about 5 to 40 percent), consolidating the web into a coherent structure by, e.g., hydraulic entanglement, ultrasonically bonding the web, adding a binder material to the fibers in solution or molten form and solidifying the binder material, adding a solvent to the web to solvent-bond the fibers together, or preparing bicomponent fibers and subjecting the web to conditions so that one component fuses, thereby fusing together adjacent or intersecting fibers. Also, the collected web may be deposited on another web, for example, a web traveling over the collector; also a second web may be applied over the uncovered surface of the collected web. The collected web may be unattached to the carrier or cover web or liner, or may be adhered to the web or liner as by heat-bonding or solvent-bonding or by bonding with an added binder material.

The blown fibers of the invention are preferably microfibers, averaging less than about 10 micrometers in diameter. Fibers of that size offer improved filtration efficiency and other beneficial properties. Very small fibers, averaging less than 5 or even 1 or less micrometer in diameter, may be blown, but larger fibers, e.g., averaging 25 micrometers or more in diameter, may also be blown, and are useful for certain purposes such as coarse filter webs.

The invention is of advantage in forming fibers of small fiber size, and fibers produced by the invention are generally smaller in diameter than fibers formed by the conventional melt-blowing conditions, but without use of an orienting chamber as used in the invention. Also, the invention melt-blown fibers have a very narrow distribution of fiber diameters. For example, in samples of webs of the invention having average fiber diameters of greater than 5 micrometers, the diameter of three-quarters or more of the fibers, ideally, 90 percent or more, have tended to lie within a range of about 3 micrometers, in contrast to a typically much larger spread of diameters in conventional melt-blown fibers. In a preferred embodiment where the fiber diameter averages less than 5 micrometers and more preferably less than about 2 micrometers, preferably the largest fibers will differ from the mean by at most about 1.0 micrometers, and generally with 90 percent or more of the fibers are within a range of less than 3.0 micrometers, preferably within a range of about 2.0 micrometers or less and most preferably within a range of 1.0 micrometer or less.

Figure 2B:
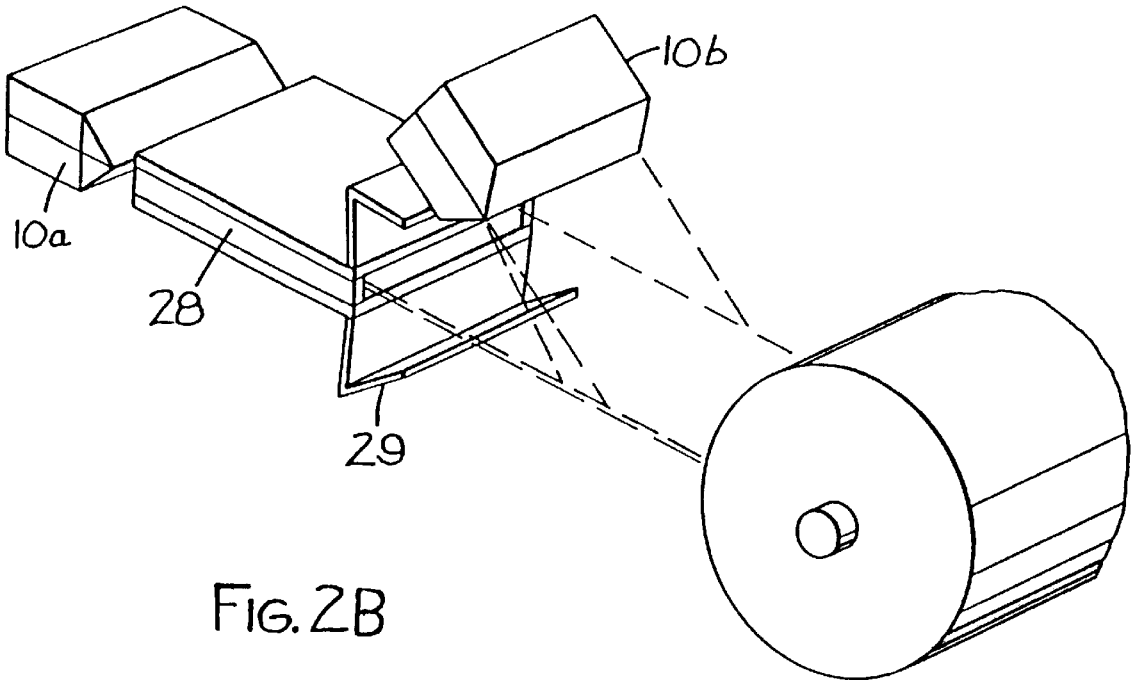
Figure 2A:
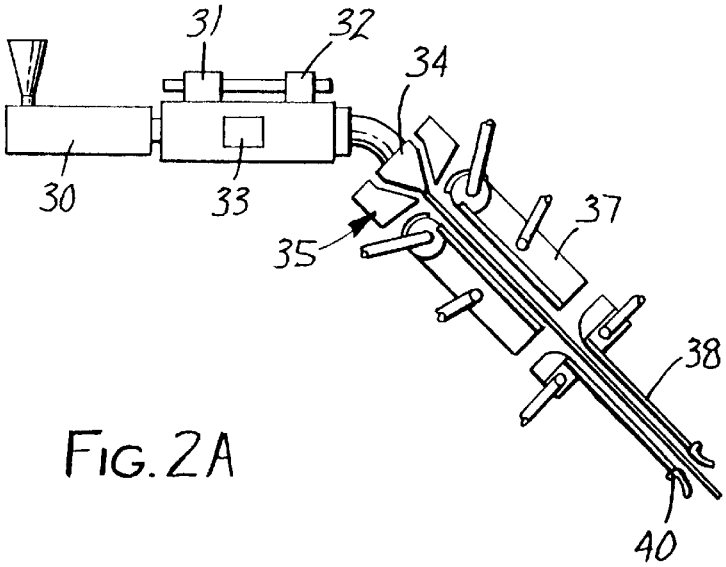

An embodiment suitable for forming fibers of extremely small average diameters, generally averaging 2 micrometers or less, with a very narrow range of fiber diameters (e.g., 90 percent within a range of 1.0 micrometers or less) is shown in FIG. 2A. The fiber-forming material from the extruder 30 is passed into a metering means that comprises at least a precision metering pump 31 or purge or the like. The metering pump 31 tends to even out the flow from the extruder 30. It has been found that for exceeding small diameter, uniform, and substantially continuous fibers, the polymer flow rate must generally be quite low through each orifice in the die. Suitable polymer flow rates for most polymers range from 0.01 to 3 gm/hr/orifice with 0.02 to 1.5 gm/hr/orifice preferred for average fiber diameters of less than 1 or 2 micrometers. In order to achieve these low flow rates, conventional extruders are operated at low screw rotation rates even with a high density of orifices in the die. This results in a polymer flow rate that fluctuates slightly. This slight flow fluctuation has been found to have a large adverse effect on the size distribution and continuity of the resulting extremely small diameter melt-blown fibers. The metering means decreases this fluctuation.

Preferably, a system of three precision pumps is employed as the metering means, as shown in FIG. 2A. Pumps 32 and 33 divide the flow from metering pump 31. Pumps 32 and 31 can be operated by a single drive with the pumps operating at a fixed ratio to one another. With this arrangement, the speed of pump 33 is continuously adjusted to provide polymer feed at a constant pressure to pump 32, measured by a pressure transducer. Pump 33 generally acts as a purge to remove excess polymer fed from the extruder and pump 31, while pump 32 provides a smooth polymer flow to the die 35. More than one pump 32 can be used to feed polymer to a series of dies (not shown). Preferably, a filter 34 is provided between the pump 32 and the die 35 to remove any impurities. Preferably, the mesh size of the filter ranges from 100 to 250 holes/in$^2$ and higher. Although this system is preferred, other arrangements are possible which provide polymer to the orifices at the necessary low and substantially non-fluctuating flow rate.

Figure 12:
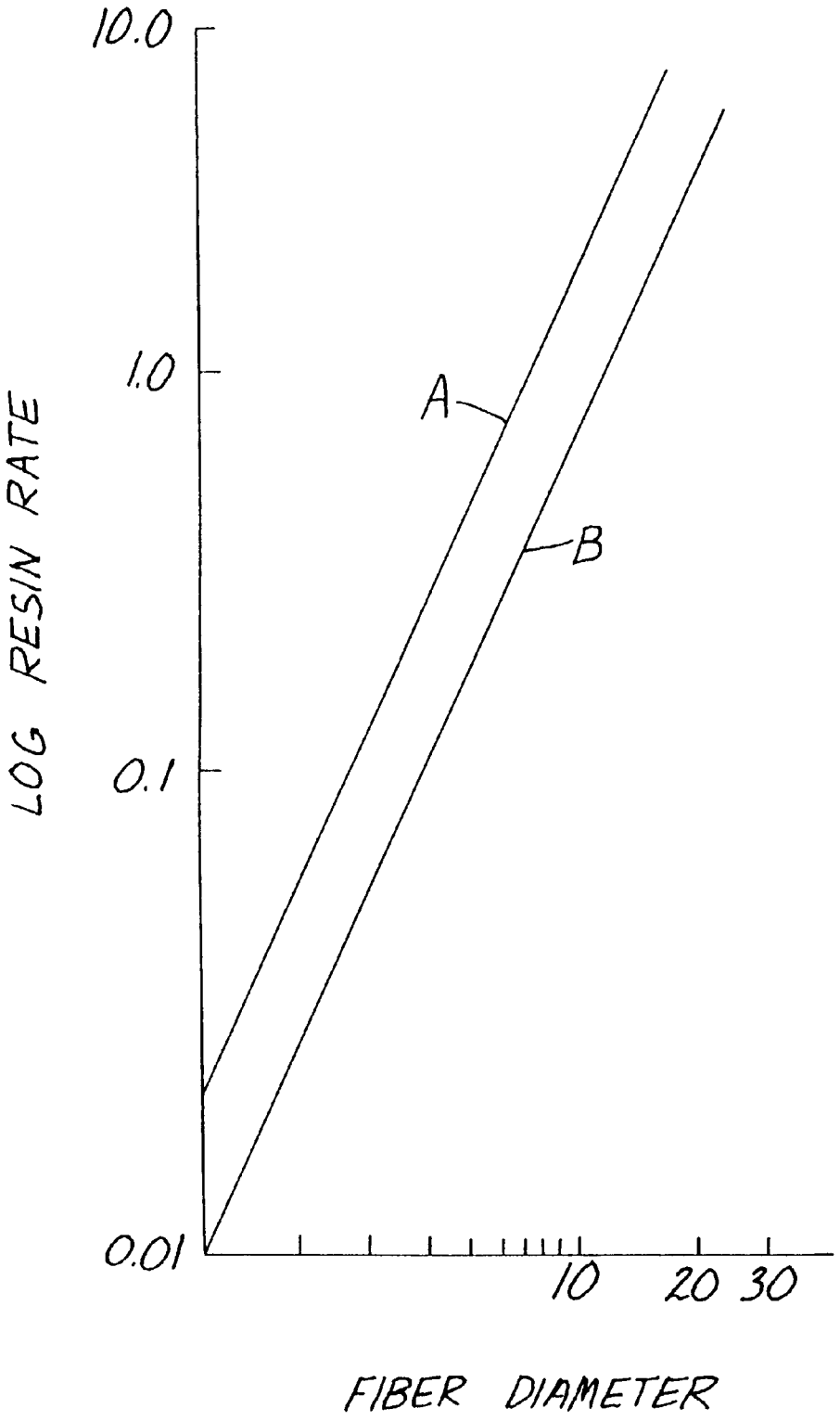
FIG. 12 is a graph showing the theoretical relationship of polymer flow rate-to-fiber diameter for the continuous submicron fibers.

The polymer is fed to the die at a flow rate per orifice suitable to produce the desired fiber diameter as shown, for example, in the hypothetical model shown in FIG. 12, where the y axis represents the log of the resin flow rate (in grams/min/orifice) and the x axis represents the corresonding 0.9 density isotactic polypropylene fiber diameter in microns at two fiber velocities (400 m/sec, upper line, and 200 m/sec, lower line). This models the demonstrated need for reduction in flow rate to produce uniform diameter microfibers. As can be seen, a very low polymer flow rate is needed to produce very small average diameter continuous microfibers using the invention process. The total theoretical polymer feed rate to the die will depend on the number of orifices. This appropriate polymer feed rate is then supplied by, e.g., the metering means. However, the invention method for obtaining uniform, continuous, high-strength, small-diameter fibers with such low polymer flow rates was not known or predictable from conventional melt-blown techniques.

Suitable orifice diameters for producing uniform fibers of average diameters of less than 2 micrometers are from 0.025 to 0.50 mm with 0.025 to 0.05 being preferred (obtainable from, e.g., Ceccato Spinnerets, Milan, Italy or Kasen Nozzle Manufacturing Corporation, Ltd., Osaka, Japan). Suitable aspect ratios for these orifices would lie in the range of 200 to 20, with 100 to 20 being preferred. For the preferred orifices, high orifice densities are preferred to increase polymer throughput. Generally, orifice densities of 30/cm are preferred with 40/cm or more being more preferred.

When producing uniform fibers having average diameters of less than 2 micrometers, the primary air pressure is reduced, decreasing the tendency for fiber breakage while still attenuating and drawing out the polymeric meltstreams extruded from the die orifices. Generally, air pressures of less than 10 lbs/in$^2$ PSI (70 kPa) are preferred, and more preferably, about 5 lbs/in$^2$ (35 kPa) or less, with an air gap width of about 0.4 mm. The low air pressure decreases turbulence and allows a continuous fiber to be blown into the chamber 17 or 37 prior to fiber breakup from turbulence created in the melt blowing. The continuous fiber delivered to the chamber 17 or 37 is then drawn by orienting air (in chamber 17 or 37 and/or 38). The temperature of the primary air is preferably close to the temperature of the polymer melt (e.g., about 10° C. over the polymer melt temperature).

The fibers must be drawn by the first, and/or second, chamber from the melt-blown area at the exit of the dieface to keep the proper stress-line tension. The chambers (17 in FIG. 1, and 37 and/or 38 in FIG. 2A) keep the fibers from undergoing the oscillatory effect ordinarily encountered by melt-blown fiber at the exit of a melt-blown die. When the fibers do undergo these oscillatory forces, for randomization purposes, the fibers are strong enough to withstand the forces without breaking. The resulting oriented fibers are substantially continuous and no fiber ends have been observed when viewing the resulting microfiber webs under a scanning electron microscope.

From the die orifices, the fiber-forming material is entrained in the primary air, and then, the orienting air and secondary cooling air, as described above for chamber 17 or chamber 37 (which can be used with or without chamber 38). In a preferred arrangement, the material exits chamber 37 and is further attenuated in chamber 38. Tubular chamber 38 operates in a manner similar to chamber 37. If the secondary chamber 38 is used, this chamber is used primarily for orientation in which case the air pressure is generally at least 50 PSI (344 kPa) and preferably at least 70 PSI (483 kPa) for a gap width of the air orifice (not shown) of 0.005 inches (0.13 mm). When this secondary chamber 38 is used, the corresponding pressures in the first chamber 37 for an identical gap width would generally be 5 PSI to 15 PSI (35 to 103 kPa). The first chamber 37 in this instance would act primarily as a cooling chamber with a slight degree of orientation occuring.

The secondary chamber 38 is generally located from 2 to 5 cm from the exit of the first chamber, which first chamber would not be flared as described above. The secondary chamber dimensions are substantially similar to those of the first chamber 37. If the secondary chamber 38 is employed, preferably its exit end 40 would be flared as described above with respect to the FIG. 1 embodiment.

The ramdomization of the fibers is further enhanced by use of an airstream immediately prior to the fibers reaching the flared exit 40. This can be done by an entangling airstream provided from the chamber walls. This entangling airstream could be provided through apperatures in the sidewalls (preferably widthwise) and preferably close to the exit end 40 of the chamber 38. Such an airstream could also be used in an arrangement such as described for FIG. 1.

The above-described embodiment is used primarily for obtaining extremely small-diameter, substantially continuous fibers, e.g., less than 2 micrometers average diameter fibers, with very a narrow ranges of fiber diameters and with high-fiber strength. This combination of properties in a microfiber web is unique and highly desirable for uses such as filtration or insulation.

As discussed above, the oriented melt-blown fibers of the invention are believed to be continuous, which is apparently a fundamental distinction from fibers formed in conventional melt-blowing processes, where the fibers are typically said to be discontinuous. The fibers are delivered to the orienting chamber(s) (or to the quenching then orienting chamber) unbroken, then generally travel through the orienting chamber without interruption. The chamber(s) generates a stress line tension which orients the fibers to a remarkable extent and prevents the fibers from oscillating significantly until after they are fully oriented. There is no evidence of fiber ends or shot (solidified globules of fiber-forming material such as occur when a fiber breaks and the release of tension permits the material to retract back into itself) found in the collected web. These features are present even with the embodiment wherein the fibers average diameter is less than 2 micrometers, which is particularly remarkable in view of the low strength of the extremely small diameter polymer flowstreams exiting the die orifices. Also, the fibers in the web show little, if any, thermal bonding between fibers.

Other fibers may be mixed into the fibrous webs of the invention, e.g., by feeding the other fibers into the stream of blown fibers after it leaves the last tubular chamber and before it reaches a collector. U.S. Pat. No. 4,118,531 teaches a process and apparatus for introducing into a stream of melt-blown fibers crimped staple fibers which increase the loft of the collected web, and such process and apparatus are useful with fibers of the present invention. U.S. Pat. No. 3,016,599 teaches such a process for introducing uncrimped fibers. The additional fibers can have the function of opening or loosening the web, of increasing the porosity of the web, and of providing a gradation of fiber diameters in the web.

Furthermore, added fibers can function to give the collected web coherency. For example, fusible fibers, preferably bicomponent fibers that have a component that fuses at a temperature lower than the fusion temperature of the other component, can be added and the fusible fibers can be fused at points of fiber intersection to form a coherent web. Also, it has been found that addition of crimped staple fibers to the web, such as described in U.S. Pat. No. 4,118,531, will produce a coherent web. The crimped fibers intertwine with one another and with the oriented fibers in such a way as to provide coherency and integrity to the web.

Webs comprising a blend of crimped fibers and oriented melt-blown fibers (e.g., comprising staple fibers in amounts up to about 90 volume percent, with the amount preferably being less than about 50 volume percent of the web) have a number of other advantages, especially for use as thermal insulation. First, the addition of crimped fibers makes the web more bulky or lofty, which enhances insulating properties. Further, the oriented melt-blown fibers tend to be of small diameter and to have a narrow distribution of fiber diameters, both of which can enhance the insulating quality of the web since they contribute to a large surface area per volume-unit of material. Another advantage is that the webs are softer and more drapable than webs comprising non-oriented melt-blown microfibers, apparently because of the absence of thermal bonding between the collected fibers. At the same time, the webs are very durable because of the high strength of the oriented fibers, and because the oriented nature of the fiber makes it more resistant to high temperatures, dry cleaning solvents, and the like. The latter advantage is especially important with fibers of polyethylene terephthalate, which tends to be amorphous in character when made by conventional melt-blowing procedures. When subjected to higher temperatures the amorphous polyester polymer can crystallize to a brittle form, which is less durable during use of the fabric. But the oriented polyester fibers of the invention can be heated without a similar degradation of their properties.

It has also been found that lighter-weight webs of the invention can have equivalent insulating value as heavier webs made from non-oriented melt-blown fibers. One reason is that the smaller diameter of the fibers in a web of the invention, and the narrow distribution of fiber diameters, causes a larger effective fiber surface area in a web of the invention, and the larger surface area effectively holds more air in place, as discussed in U.S. Pat. No. 4,118,531. Larger surface area per unit weight is also achieved because of the absence of shot and "roping" (grouping of fibers such as occurs in conventional melt-blowing through entanglement or thermal bonding).

Coherent webs may also be prepared by mixing oriented melt-blown fibers with non-oriented melt-blown fibers. An apparatus for preparing such a mixed web is shown in FIG. 213 and comprises first and second melt-blowing dies 10*a* and 10*b* having the structure of the die 10 shown in FIG. 1, and at least one orienting chamber 28 through which fibers extruded from the first die 10A pass and die 35 of FIG. 2A. The chamber 28 is like the chamber 17 shown in FIG. 1 and chambers 37 and 38 of FIG. 2A, except that the randomizing portion 29 at the end of the orienting chamber has a different flaring than does the randomizing portion 24 or 40 shown in FIGS. 1 and 2A. In the apparatus of FIG. 2B, the chamber flares rapidly to an enlarged height, and then narrows slightly until it reaches the exit. While such a chamber provides an improved isotropic character to the web, the more gradual flaring of the chamber shown in FIG. 1 provides more isotropic character.

Polymer introduced into the second die 10B is extruded through a set of orifices and formed into fibers in the same way as fibers formed by the first die 10A, but the prepared fibers are introduced directly into the stream of fibers leaving the orienting chamber 28. The proportion of oriented-to-non-oriented fibers can be varied greatly and the nature of the fibers (e.g., diameter, fiber composition, bicomponent nature) can be varied as desired. Webs can be prepared that have a good isotropic balance of properties, e.g., in which the cross-direction tensile strength of the web is at least about three-fourths of the machine-direction tensile strength of the web.

Some webs of the invention include particulate matter, which may be introduced into the web in the manner disclosed in U.S. Pat. No. 3,971,373, e.g., to provide enhanced filtration. The added particles may or may not be bonded to the fibers, e.g., by controlling process conditions during web formation or by later heat treatments or molding operations. Also, the added particulate matter can be a supersorbent material such as taught in U.S. Pat. No. 4,429,001.

The fibers may be formed from a wide variety of fiber-forming materials. Representative polymers for forming melt-blown fibers include polypropylene, polyethylene, polyethylene terephthalate, and polyamide. Nylon 6 and nylon 66 are especially useful materials because they form fibers of very high strength.

Fibers and webs of the invention may be electrically charged to enhance their filtration capabilities, as by introducing charges into the fibers as they are formed, in the manner described in U.S. Pat. No. 4,215,682, or by charging the web after formation in the manner described in U.S. Pat. No. 3,571,679; see also U.S. Pat. Nos. 4,375,718, 4,588,537 and 4,592,815. Polyolefins, and especially polypropylene, are desirably included as a component in electrically charged fibers of the invention because they retain a charged condition well.

Fibrous webs of the invention may include other ingredients in addition to the microfibers. For example, fiber finishes may be sprayed onto a web to improve the hand and feel of the web. Additives, such as dyes, pigments, fillers, surfactants, abrasive particles, light stabilizers, fire retardants, absorbents, medicaments, etc., may also be added to webs of the invention by introducing them to the fiber-forming liquid of the microfibers, or by spraying them on the fibers as they are formed or after the web has been collected.

A completed web of the invention may vary widely in thickness. For most uses, webs have a thickness between about 0.05 and 5.0 centimeters. For some applications, two or more separately formed webs may be assembled as one thicker sheet product.

The invention will be further described by reference to the following illustrative examples.

EXAMPLE 1

Using the apparatus of FIG. 2, minus the second die 10*b*, oriented microfibers were made from polypropylene resin (Himont PE 442, supplied by Himont Corp., Wilmington, Del., having a melt-flow index (MFI) of 800–1000). The die temperature was 200° C., and the primary air temperature was 190° C. The primary air pressure was 10 PSI (70 kPa), with gap width in the orifices 15 being between 0.015 and 0.018 inch (0.038 and 0.046 cm). The polymer was extruded through the die orifices at a rate of about 0.009 pound per hour per orifice (89 g/hr/orifice).

From the die, the fibers were drawn through a box-like tubular orienting chamber as shown in FIG. 2 having an interior height of 0.5 inch (1.3 cm), an interior width of 24 inches (61 cm), and a length of 18 inches (46 cm). The randomizing or expansion portion 29 of the chamber was 24 inches (61 cm) long, and as illustrated in the drawing, was formed by portions of the large-area walls defining the orienting chamber, which flared at 90° to the portions of the walls defining the main portion 28 of the chamber; the wall flared to a 6 inch (15.24 cm) height at the point of their connection to the main portion of the chamber, and then narrowed to a 5 inch (12.7 cm) height over its 24 inch (61 cm) length. Secondary air having a temperature of about 25° C. was blown into the orienting chamber at a pressure of 70 PSI (483 kPa) through orifices (like the orifices 19 shown in FIG. 1) having a gap width of 0.005 inch (0.013 cm).

The completed fibers exited the chamber at a velocity of about 5644 meters/minute and were collected on a screen-type collector spaced about 36 inches (91 cm) from the die and moving at a rate of about 5 meters per minute. The fibers ranged in diameter between 1.8 and 5.45 microns and had an average diameter of about 4 microns. The speed/draw ratio for the fibers (the ratio of exit velocity-to-initial extrusion velocity) was 11,288 and the diameter draw ratio was 106.

Figure 3A:
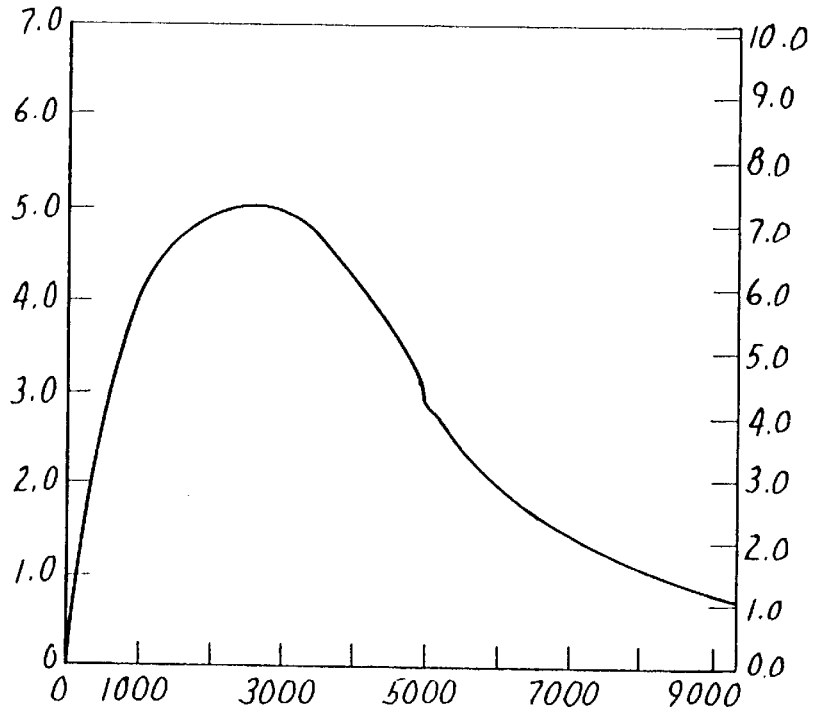
FIGS. 3, 5 and 9 are plots of stress-strain curves for fibers of the invention (the "A" drawings) and comparative fibers (the "B" drawings).

The tensile strength of the fibers was measured by testing a collected embossed web of the fibers (embossed over about 34 percent of its area with 0.54-square-millimeter-sized diamond-shaped spots) with an Instron tensile testing machine. The test was performed using a gauge length, i.e., a separation of the jaws, of as close to zero as possible, approximately 0.009 centimeter. Results are shown in FIG. 3A. Stress is plotted in dynes/cm$^2$×10$^7$ on the ordinate and nominal strain in percent on the abscissa (stress is plotted in psi×10$^2$ on the right-hand ordinate). Young's modulus was 4.47×10$^6$ dynes/cm$^2$, break stress was 4.99×10$^7$ dynes/cm$^2$ and toughness (the area under the curve) was 2.69×10$^9$ ergs/cm$^3$. By using a very small spacing between jaws of the tensile testing machine, the measured values reflect the values on average for individual fibers, and avoid the effect of the embossing. The sample tested was 2 centimeters wide and the crosshead rate was 2 cm/minute.

Figure 3B:
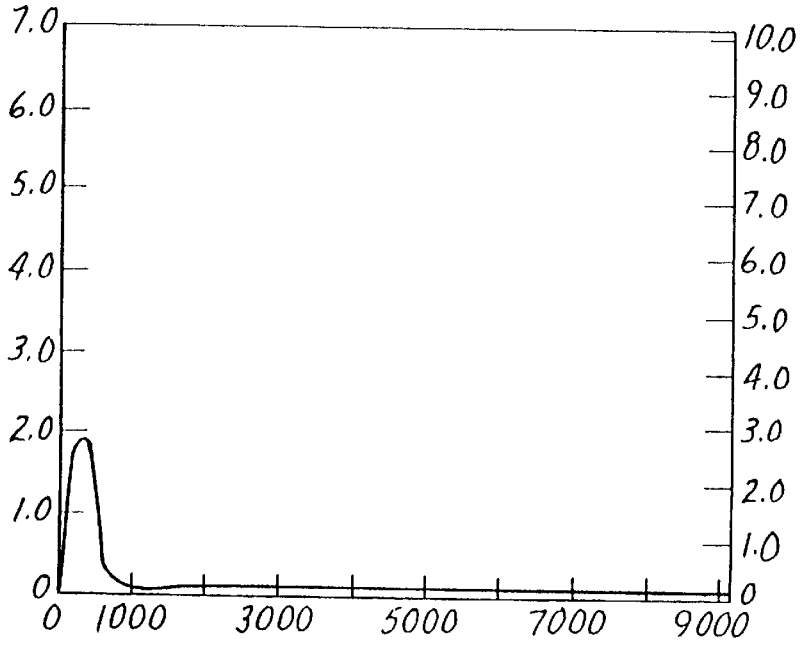

For comparative purposes, tests were also performed on microfibers like those of this example, i.e., prepared from the same polypropylene resin and using the 30 same apparatus, except that they were not passed through the orienting chamber. These comparative fibers ranged in diameter between 3.64 and 12.73 microns in diameter, and had a mean diameter of 6.65 microns. The stress-strain curve is shown in FIG. 3B. Young's modulus was 1.26×10$^6$ dynes/cm$^2$, break stress was 1.94×10$^7$ dynes/cm$^2$, and toughness was 8.30×10$^8$ ergs/cm$^3$. It can be seen that the more oriented microfibers produced by the process of the present invention had higher values in these properties by between 250 and over 300% than the microfibers prepared in the conventional process.

Figure 4A:
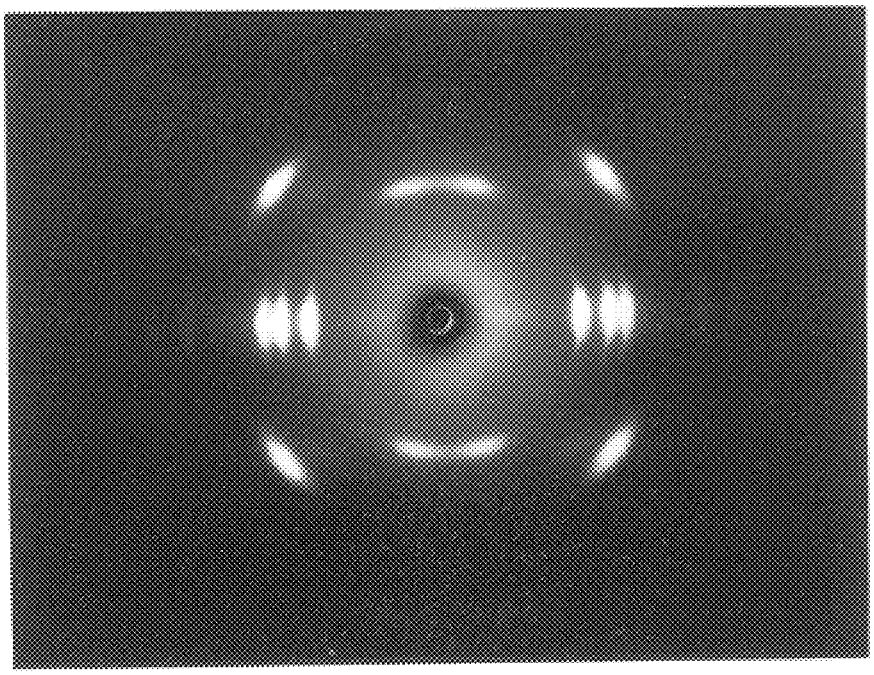
FIGS. 4, 7, 8, 10 and 11 are WAX photographs of fibers of the intention (the "A" photographs) and comparative fibers ("B" photographs)
Figure 4B:
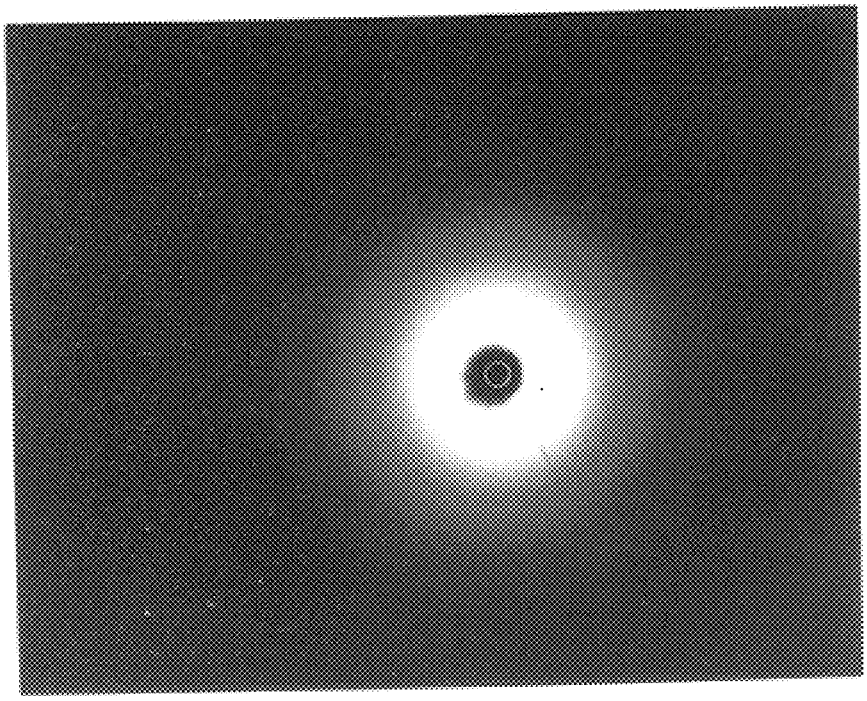

WAXS (wide angle x-ray scattering) photographs were prepared for the oriented fibers of the invention and the comparative unoriented fibers, and are pictured in FIG. 4A (fibers of the invention) and 4B (comparative fibers) (as is well understood in preparation of WAXS photographs of fibers, the photo is taken of a bundle of fibers such as obtained by collecting such a bundle on a rotating mandrel placed in the fiber stream exiting from the orienting chamber, or by cutting fiber lengths from a collected web and assembling the cut lengths into a bundle). The crystalline orientation of the oriented microfibers is readily apparent from the presence of rings, and the interruption of those rings in FIG. 4A.

Crystalline axial orientation function (orientation along the fiber axis) was also determined for the fibers of the invention (using procedures as described in Alexander, L. E., *X-Ray Diffraction Methods in Polymer Science*, Chapter 4, published by R. E. Krieger Publishing Co., New York, 1979; see particularly, page 241, Equation 4–21) and found to be 0.65. This value would be very low, at least approaching zero, for conventional melt-blown fibers. A value of 0.5 shows the presence of significant crystalline orientation, and preferred fibers of the invention exhibit values of 0.8 or higher.

EXAMPLE 2

Oriented nylon 6 microfibers were prepared using apparatus generally like that of Example 1, except that the main portion of the orienting chamber was 48 inches (122 cm) long. The melt-blowing die had circular smooth-surfaced orifices (25/inch) having a 5:1 length-to-diameter ratio. The die temperature was 270° C., the primary air temperature and pressure were, respectively, 270° C. and 15 PSI (104 kPa), (0.020-inch [0.05 cm] gap width), and the polymer throughput rate was 0.5 lb/hr/in (89 g/hr/cm). The extruded fibers were oriented using air in the orienting chamber at a pressure of 70 PSI (483 kPa) with a gap width of 0.005 inch (0.013 cm), and an approximate air temperature of 25° C. The flared randomizing portion of the orienting chamber was 24 inches (61 cm) long. Fiber exit velocity was about 6250 meters/minute.

Scanning electron microscopy (SEM) of a representative sample showed fiber diameters of 1.8 to 9.52 microns, with a calculated mean fiber diameter of 5.1 microns.

For comparison, an unoriented nylon 6 web was prepared without use of the orienting chamber and with a higher die temperature of 315° C. chosen to produce fibers similar in diameter to those of the oriented fibers of the invention (higher die temperature lowers the viscosity of the extruded material, which tends to result in a lower diameter of the prepared fibers; thereby the comparative fibers can approach the size of fibers of the invention, which as noted above, tend to be narrower in diameter than conventionally prepared melt-blown fibers). The fiber diameter distribution was measured as 0.3 to 10.5 microns, with a calculated mean fiber diameter of 3.1 microns.

Figure 5A:
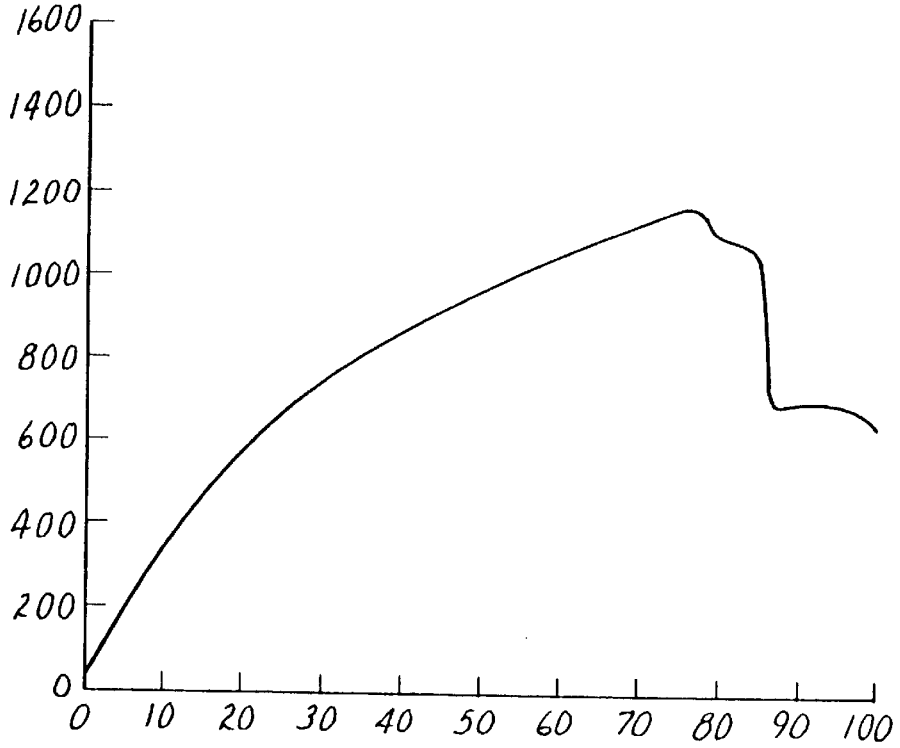
Figure 5B:
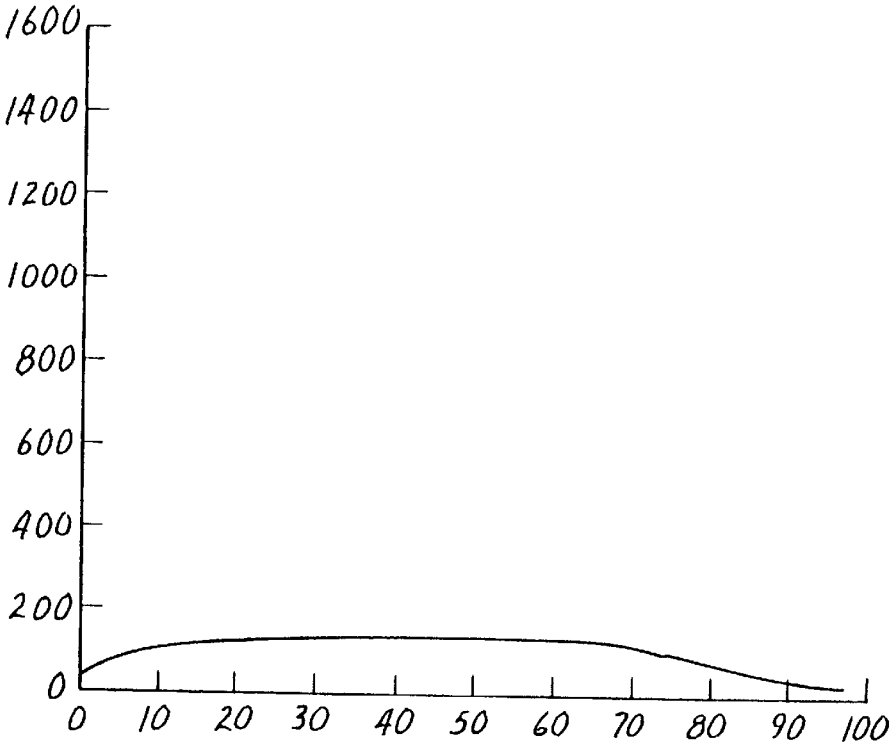

The tensile strength of the prepared fibers was measured as described in Example 1, and the resultant stress-strain curves are shown in FIGS. 5A (fibers of the invention) and 5B (comparative unoriented fibers). Units on the ordinate are in pounds/square inch and on the abscissa are in percent.

Figure 6A:
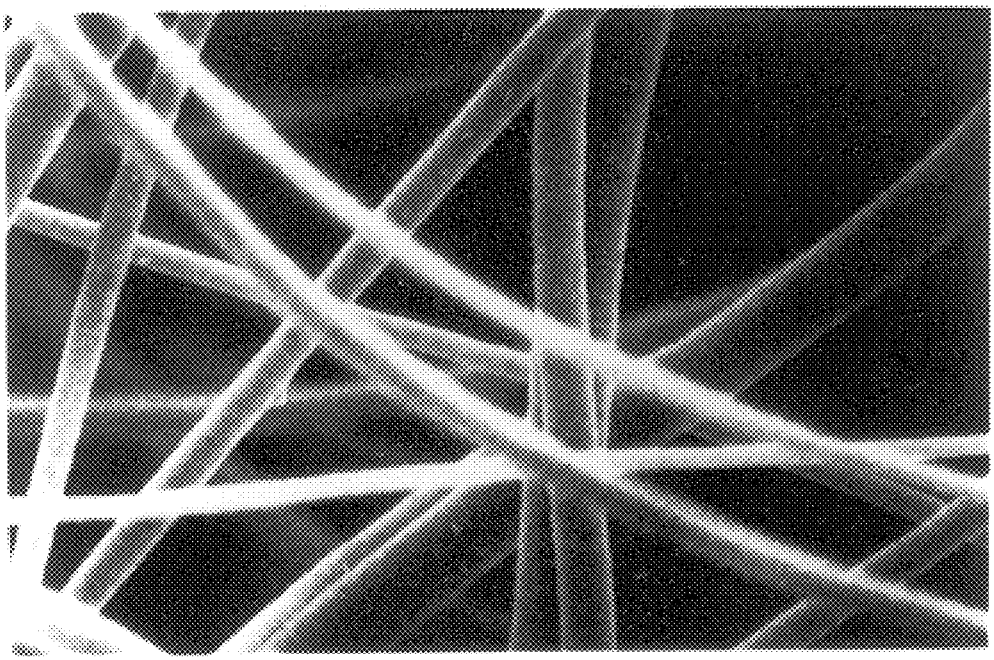
FIG. 6 comprises scanning electron microscope photographs of a representative fibrous web of the invention (6A) and a comparative fibrous web (6B).
Figure 6B:
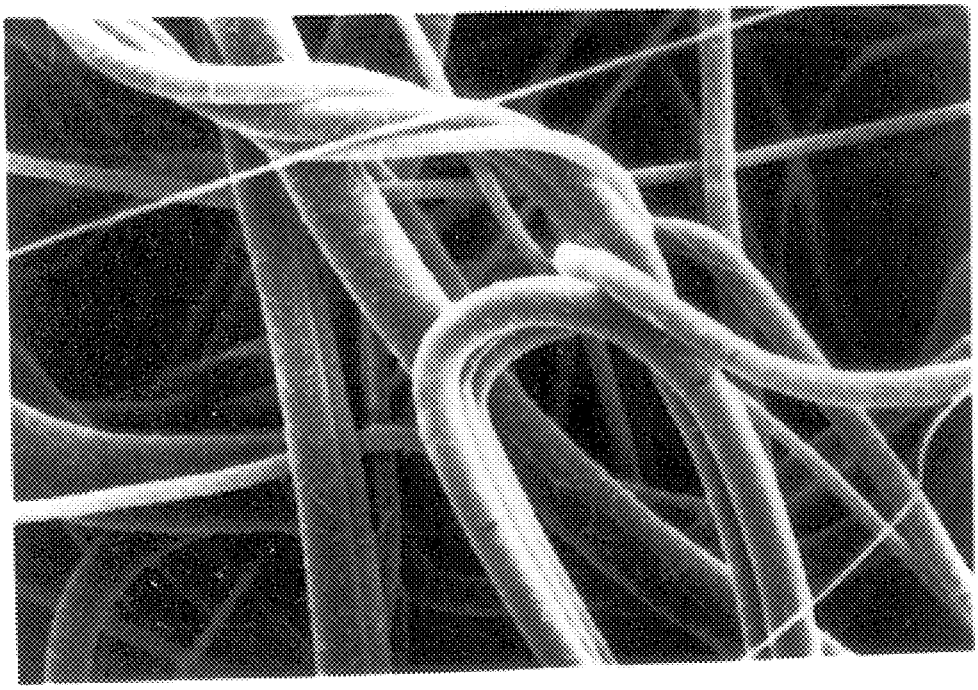

FIG. 6 presents SEM photographs of representative webs of the invention prepared as described above (6A) and of the comparative unoriented webs (6B) to further illustrate the difference between them as to fiber diameter. As will be seen, the comparative web includes very small-diameter fibers, apparently produced as a result of the great turbulence at the exit of a melt-blowing die in the conventional melt-blowing process. A much more uniform air flow occurs at the exit of the die in a process of the present invention, and this appears to contribute toward preparation of fibers that are more uniform in diameter.

Figure 7A:
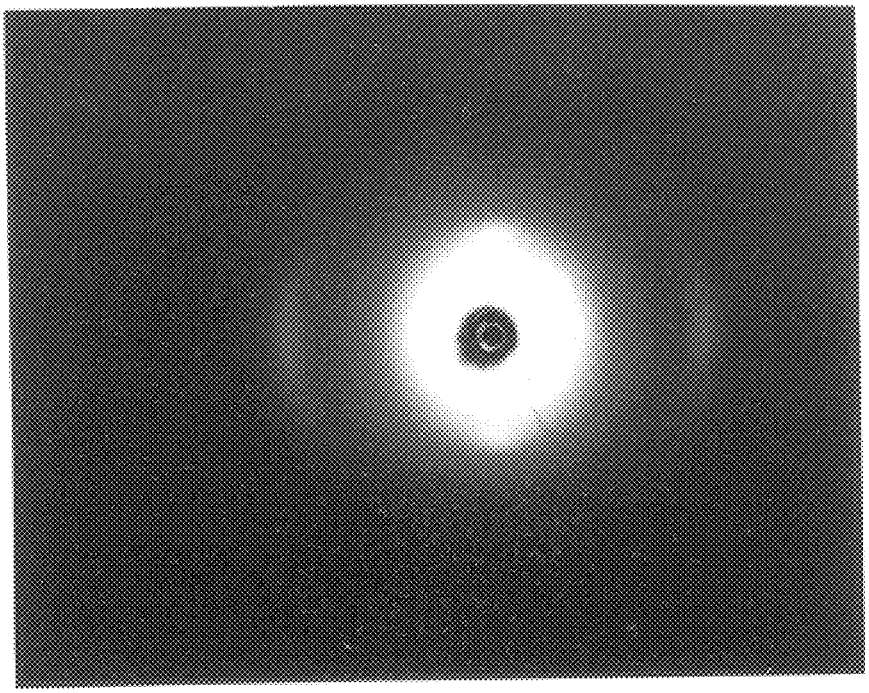
Figure 7B:
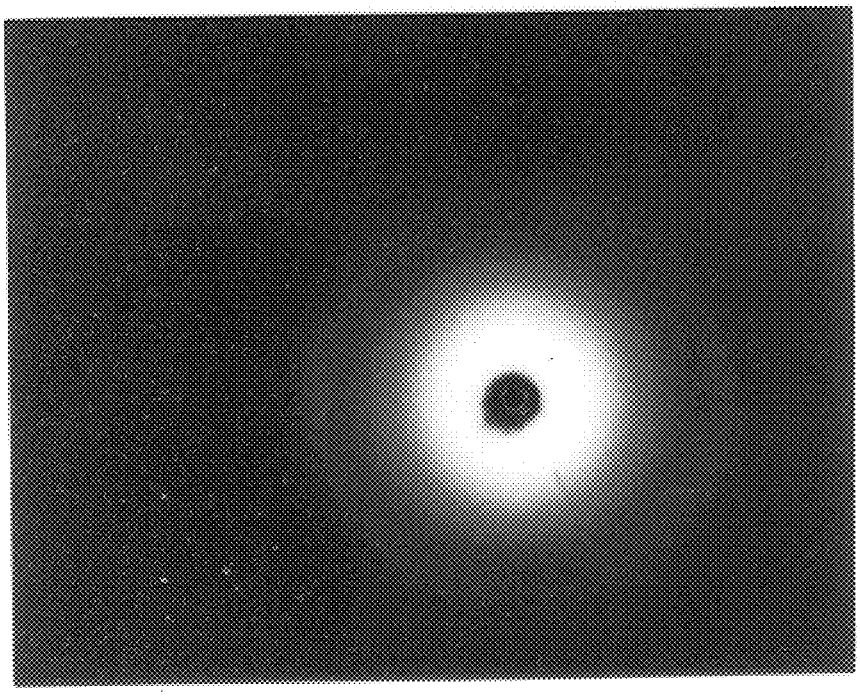

FIG. 7 presents WAXS photos for the fibers of the invention (7A) and the comparative fibers (7B).

EXAMPLE 3

Oriented microfibers of polyethylene terephthalate (Eastman A150 from Eastman Chemical Co.) were prepared using the apparatus and conditions of Example 2, except that the die temperature was 315° C., and the primary air pressure and temperature were, respectively, 20 PSI (138 kPa) and 315° C. Fiber exit velocity was about 6000 meters/minute. The distribution of fiber diameters measured by SEM was 3.18 to 7.73 microns, with a mean of 4.94 microns.

Unoriented microfibers were prepared for comparative purposes, using the same resin and operating conditions except for a slightly higher die temperature (335° C.) and the lack of the orienting chamber. The fiber diameter distribution was 0.91 to 8.8 microns with a mean of 3.81 microns.

Figure 8A:
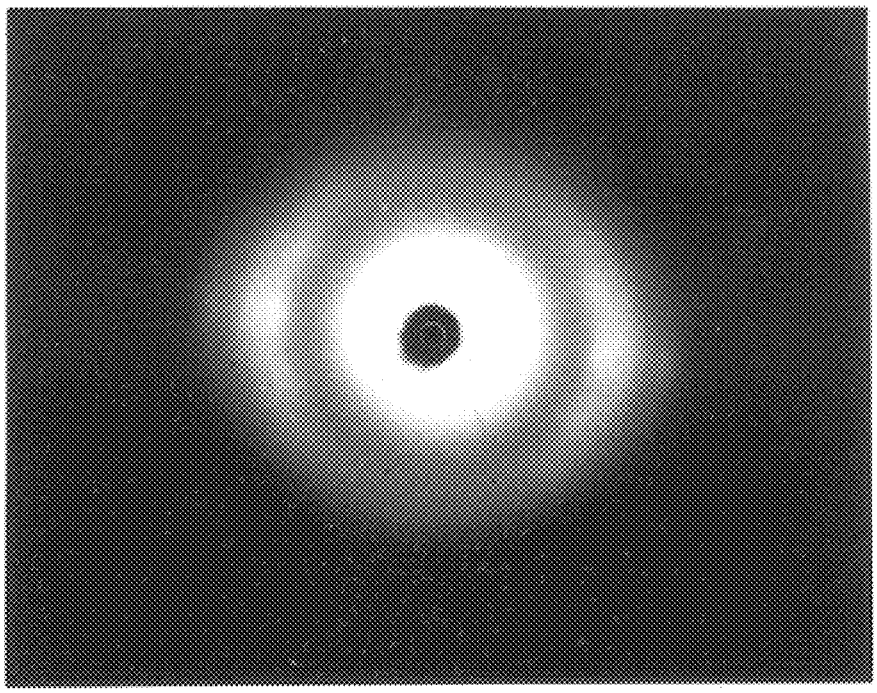
Figure 8B:
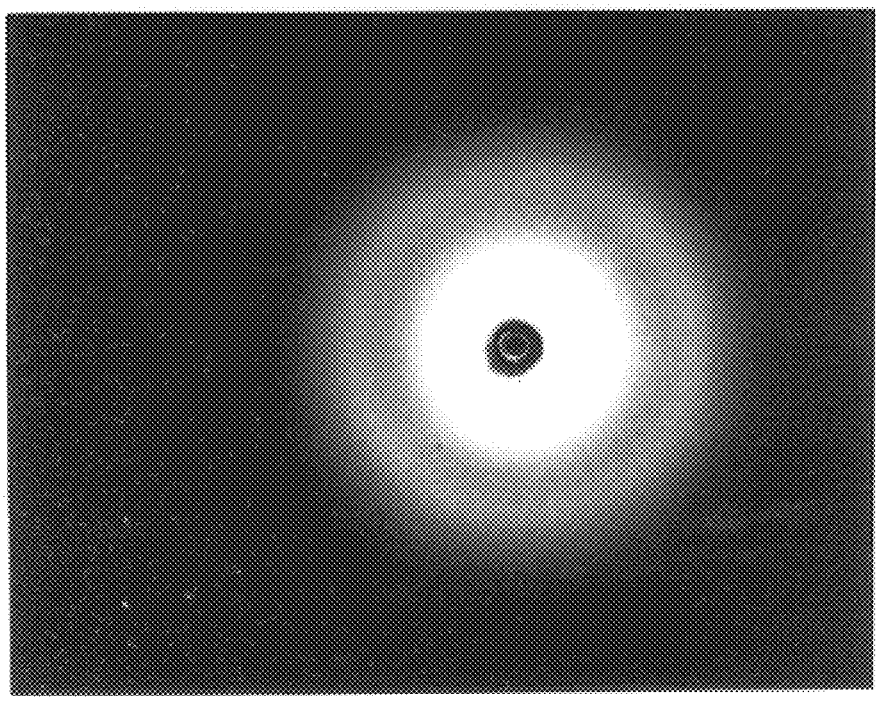

FIG. 8 shows the WAXS patterns photographed for the oriented (FIG. 8A) and comparative unoriented fibers (FIG. 8B). The increased crystalline orientation of the oriented microfibers was readily apparent.

EXAMPLES 4–6

Oriented microfibers were prepared from three different polypropylenes, having melt flow indices (MFI), respectively, of 400–600 (Example 4), 600–800 (Example 5), and 800–1000 (Example 6). The apparatus of Example 2 was used, with a die temperature of 185° C., and a primary air pressure and temperature of 200° C. and 20 PSI (138 kPa), respectively. Fiber exit velocity was about 9028 meters/minute. The 400–600-MFI microfibers prepared were found by SEM to range in diameter between 3.8 and 6.7 microns, with a mean diameter of 4.9 microns.

Figure 9A:
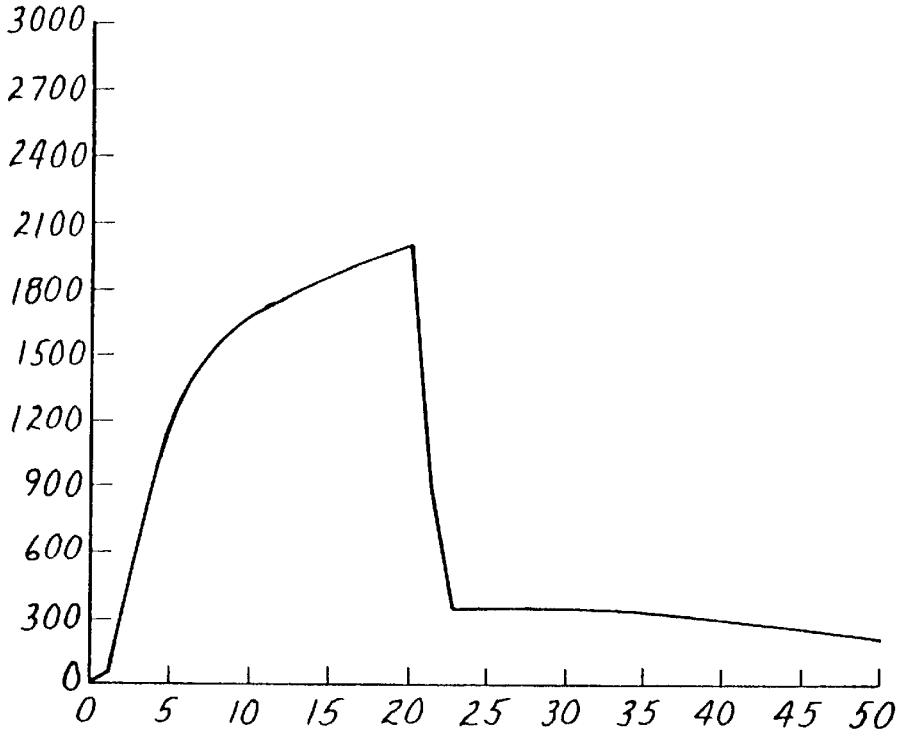
Figure 9B:
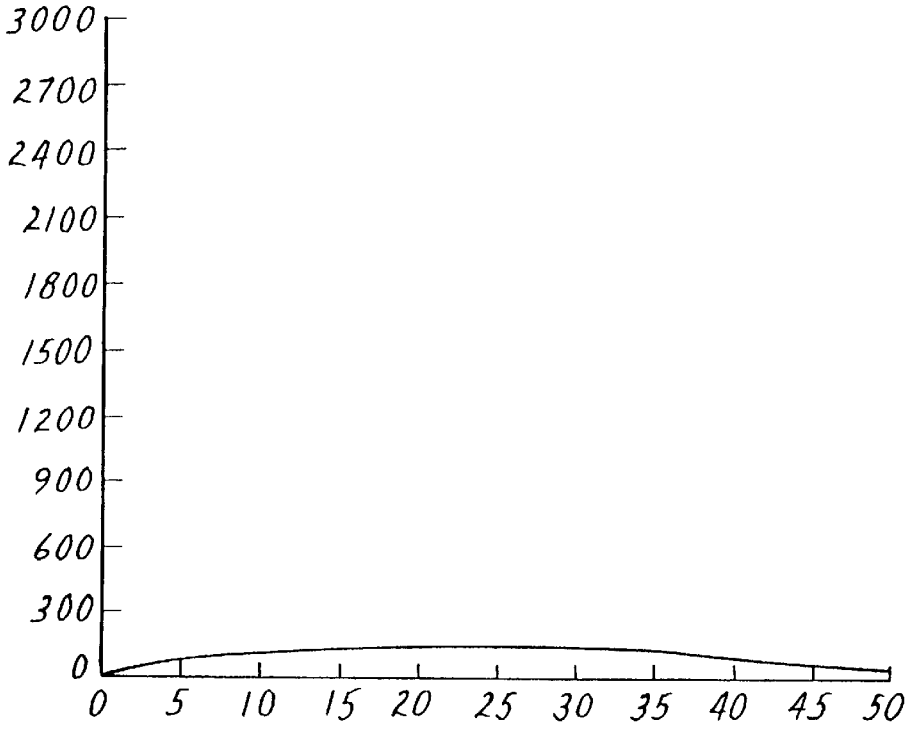
Figure 10A:
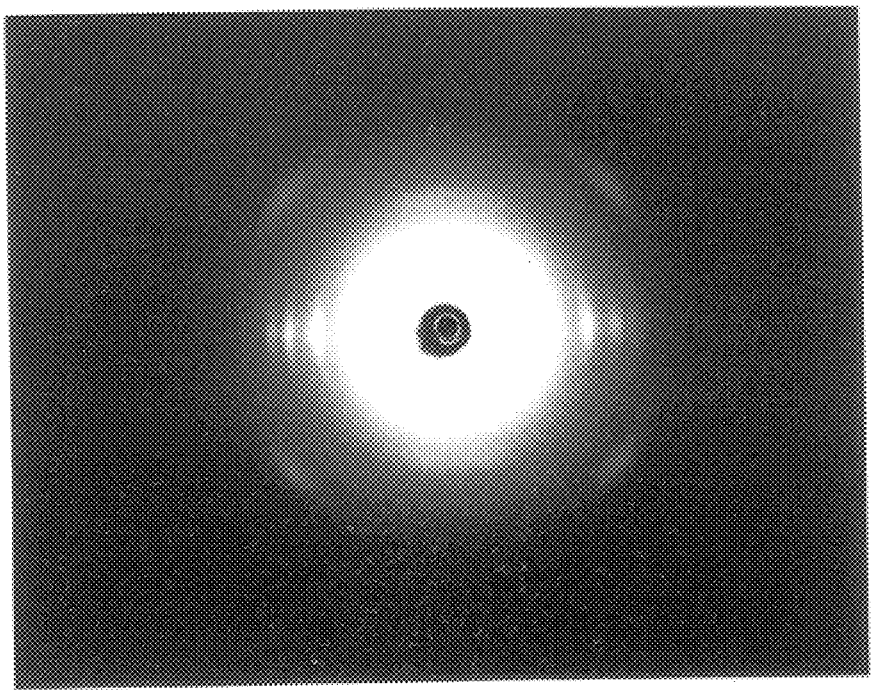
Figure 10B:
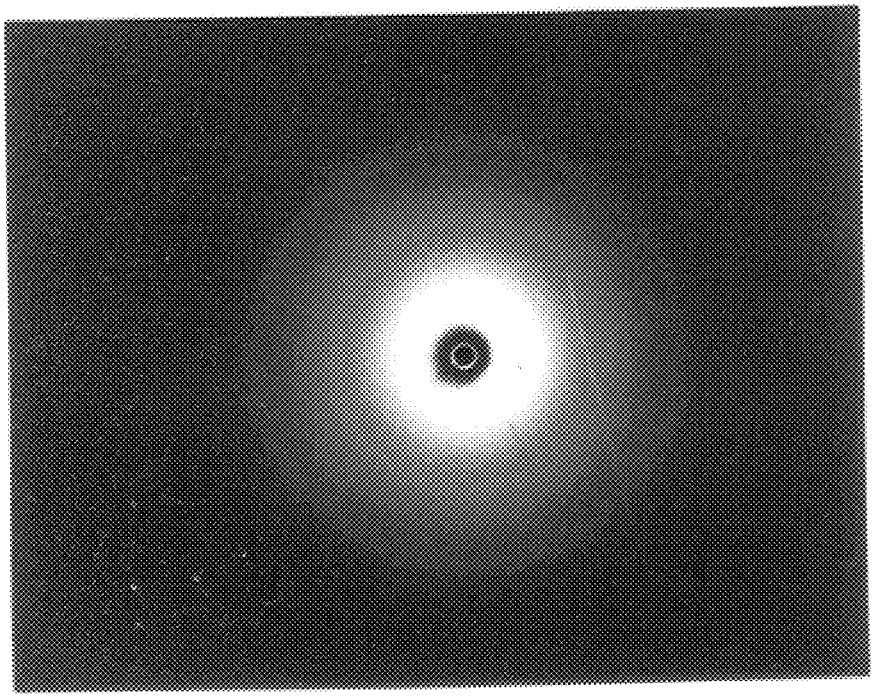
Figure 11A:
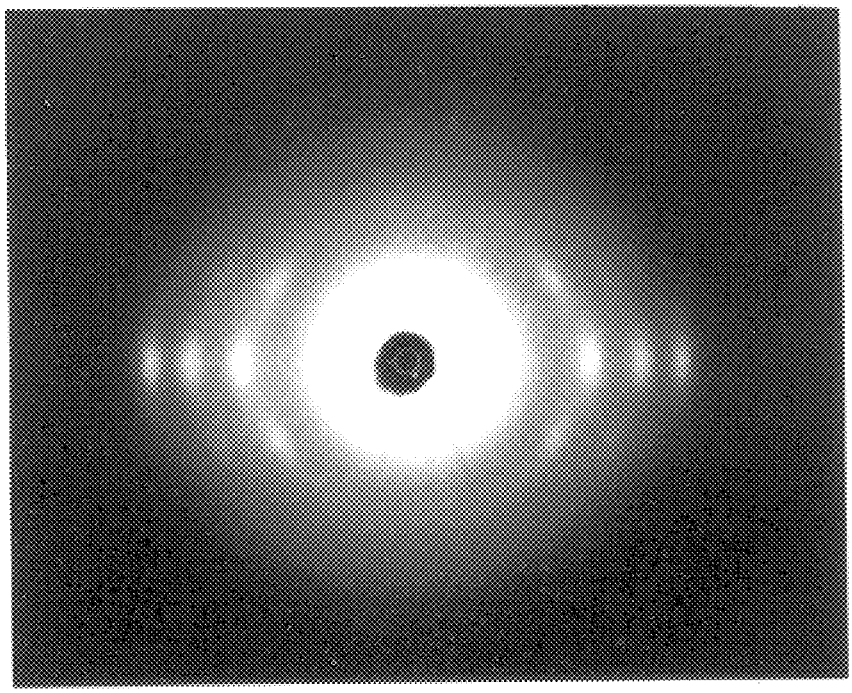
Figure 11B:
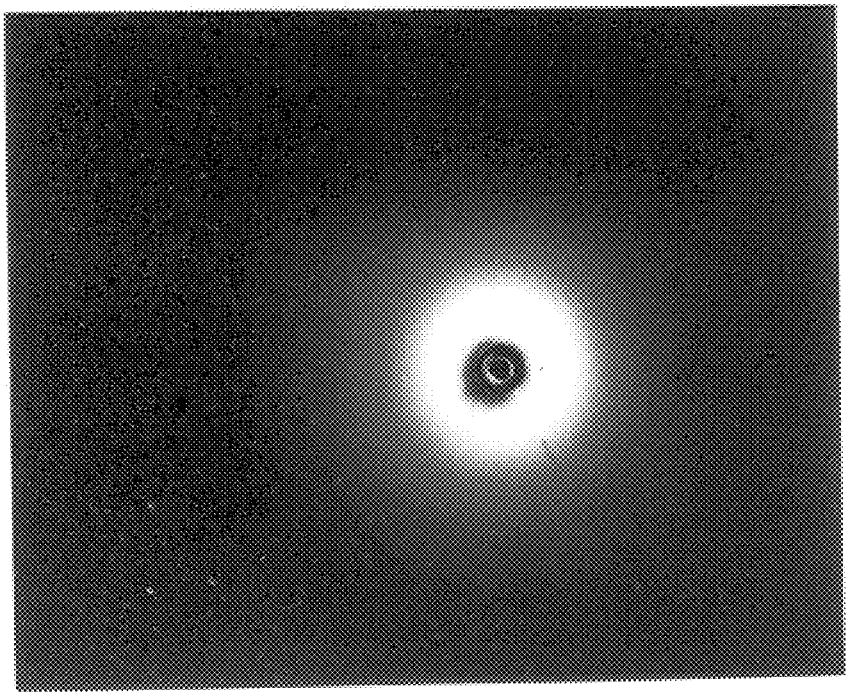

The tensile strength of the prepared 800–1000-MFI microfibers was measured using an Instron tester, and the stress-strain curves are shown in FIGS. 9A (fibers of the invention) and 9B (comparative unoriented fibers).

Unoriented microfibers were prepared for comparative purposes, using the same resins and operating conditions except for use of higher die temperature and the absence of an orienting chamber. The prepared 400–600-MFI fibers ranged from 4.55 to 10 microns in diameter, with a mean of 6.86 microns.

EXAMPLE 7

Oriented microfibers were prepared from polyethylene terephthalate (251° C. melting point, crystallizes at 65–70° C.) using the apparatus of Example 2, with a die temperature of 325° C., primary air pressure and temperature of 325° C. and 20 PSI (138 kPa), respectively, and polymer throughput of 1 lb/hr/in (178 g/hr/cm). Fiber exit velocity was 4428 meters/minute. The fibers prepared ranged in diameter between 2.86 and 9.05 microns, with a mean diameter of 7.9 microns.

Comparative microfibers were also prepared, using the same resins and operating conditions except for a higher die temperature and the absence of an orienting chamber. These fibers ranged in diameter between 3.18 and 14.55 microns and had an average diameter of 8.3 microns.

EXAMPLES 8–12

Webs were prepared on the apparatus of Example 2, except that the randomizing portion of the orienting chamber was flared in the manner pictured in FIG. 1 and was 20 inches (51 cm) long. Only the two wide walls of the chamber were flared, and the angle 0 of flaring was 6°. Conditions were as described in Table I below. In addition, comparative webs were prepared from the same polymeric materials, but without passing the fibers through an orienting chamber; conditions for the comparative webs are also given in Table I (under the label "C"). Additional examples (11x and 12x) were also prepared using conditions like those described in Examples 11 and 12, except that the flared randomizing portion of the orienting chamber was 24 inches (61 centimeters) long. The webs were embossed with star patterns (a central dot and six line-shaped segments radiating from the dot), with the embossing covering 15 percent of the area of the web, and being prepared by passing the web under an embossing roller at a rate of 18 feet per minute, and using embossing temperatures as shown in Table I and a pressure of 20 PSI (138 kPa). Both the webs of the invention and the comparative webs were tested for grab tensile strength and strip tensile strength (procedures described in ASTM D 1117 and D 1682) in both the machine direction (MD)—the direction the collector rotates—and the transverse or cross direction (TD), and results are given in Tables II and III. Elmendorf tear strength (ASTM D 1424) was also measured on some samples, and is reported in Table IV.

TABLE I

| Example No. | 8 | 8C | 9 | 9C | 10 | 10C | 11 | 11C | 12 | 12C |
|---|---|---|---|---|---|---|---|---|---|---|
| Polymer | Polypropylene | | Nylon 6 | | Nylon 66 | | Polyethylene Terephthalate | | Polybutylene Terephthalate | |
| Die Temperature (°C.) | 190 | 275 | 275 | 300 | 300 | 300 | 300 | 325 | 260 | 300 |
| Primary Air | | | | | | | | | | |
| Pressure (psi) | 10 | 30 | 15 | 30 | 15 | 30 | 15 | 30 | 15 | 30 |
| (kPa) | 69 | 206 | 103 | 206 | 103 | 206 | 103 | 206 | 103 | 206 |
| Temperature (°C.) | 190 | 275 | 275 | 275 | 300 | 300 | 280 | 280 | 260 | 280 |
| Orienting Chamber | | | | | | | | | | |
| Pressure (psi) | 70 | | 75 | | 50 | | 70 | | 70 | |
| (kPa) | 483 | | 516 | | 344 | | 483 | | 483 | |
| Temperature (°C.) | ambient | | ambient | | ambient | | ambient | | ambient | |
| Polymer Throughput Per Inch Width | | | | | | | | | | |
| (lb/hr/in) | 0.5 | | 0.5 | | 1 | 1 | 1 | 1 | 1 | 1 |
| (kg/hr/cm) | 0.089 | | 0.089 | | 0.178 | 0.178 | 0.178 | 0.178 | 0.178 | 0.178 |
| Embossing | | | | | | | | | | |
| Temperature (°C.) | 149 | 104 | 200 | 135 | 220 | 220 | 218 | 110 | 204 | 188 |

TABLE II

Grab Tensile Strength

| Example No. | Machine Direction Load (lb) | Machine Direction Load (N) | Machine Direction Specific Strength (N/g/m$^2$) | Machine Direction % Elongation | Cross Direction Load (lb) | Cross Direction Load (N) | Cross Direction Specific Strength (N/g/m$^2$) | Cross Direction % Elongation | Basis Weight (g/m$^2$) |
|---|---|---|---|---|---|---|---|---|---|
| 8 | 25.81 | 114.81 | 2.09 | 59.40 | 22.51 | 100.13 | 1.82 | 64.80 | 55 |
| 8C | 8.45 | 37.59 | 0.696 | 106.40 | 8.07 | 35.90 | 0.665 | 104.00 | 54 |
| 9 | 28.67 | 127.53 | 2.50 | 77.20 | 23.06 | 102.58 | 2.01 | 94.20 | 51 |
| 9C | 9.03 | 40.17 | 0.772 | 187.40 | 6.18 | 27.49 | 0.529 | 132.40 | 52 |
| 10 | 41.78 | 185.85 | 4.13 | 97.80 | 18.02 | 80.16 | 1.78 | 103.80 | 45 |
| 10C | 16.49 | 73.35 | 1.36 | 132.20 | 9.50 | 42.26 | 0.782 | 122.60 | 54 |
| 11 | 45.02 | 200.26 | 4.01 | 136.00 | 32.38 | 144.03 | 2.88 | 126.00 | 50 |
| 11C | 13.24 | 58.89 | 1.20 | 275.60 | 9.36 | 41.64 | 0.850 | 250.40 | 49 |
| 12 | 23.19 | 103.15 | 1.84 | 172.60 | 17.24 | 76.69 | 1.37 | 181.60 | 56 |
| 12C | 12.49 | 55.56 | 1.05 | 248.20 | 10.25 | 45.59 | 0.860 | 203.20 | 53 |
| 12X | 10.64 | 47.33 | 0.876 | 274.60 | 17.63 | 78.42 | 1.45 | 237.80 | 54 |

TABLE III

Strip Tensile Strength

| Example No. | Jaw Grip (In.) | Jaw Grip (cm) | Machine Direction Load (lb) | Machine Direction Load (N) | Machine Direction Specific Strength (N/g/m$^2$) | Machine Direction % Elongation | Cross Direction Load (lb) | Cross Direction Load (N) | Cross Direction Specific Strength (N/g/m$^2$) | Cross Direction weight Elongation | Basis (g/m$^2$) |
|---|---|---|---|---|---|---|---|---|---|---|---|
| 8 | 3 | 7.6 | 11.44 | 50.89 | 0.925 | 68.50 | 10.1 | 44.92 | 0.817 | 57.80 | 55 |
| | 1 | 2.5 | 10.58 | 47.06 | 0.856 | 24.40 | 9.22 | 41.01 | 0.746 | 21.60 | |
| | 0 | 0 | 12.64 | 56.23 | 1.022 | 29.00 | | | | | |
| 8C | 3 | 7.6 | 2.78 | 12.37 | 0.229 | 65.40 | 2.60 | 11.57 | 0.214 | 73.80 | 54 |
| | 1 | 2.5 | 3.00 | 13.34 | 0.247 | 20.80 | 2.71 | 12.05 | 0.223 | 24.60 | |
| | 0 | 0 | 3.83 | 17.04 | 0.315 | 20.60 | | | | | |
| 9 | 3 | 7.6 | 12.17 | 54.13 | 0.942 | 36.40 | 10.35 | 46.04 | 0.903 | 40.80 | 51 |
| | 1 | 2.5 | 12.63 | 58.18 | 1.10 | 12.60 | 14.15 | 62.94 | 1.23 | 16.40 | |
| | 0 | 0 | 18.35 | 81.62 | 1.60 | 9.00 | | | | | |
| 9C | 3 | 7.6 | 3.03 | 13.48 | 0.259 | 87.80 | 1.88 | 8.36 | 0.161 | 79.00 | 52 |
| | 1 | 2.5 | 3.44 | 15.30 | 0.294 | 31.40 | 2.05 | 9.12 | 0.175 | 41.17 | |
| | 0 | 0 | 4.21 | 18.73 | 0.360 | 29.8 | | | | | |
| 10 | 3 | 7.6 | 17.35 | 77.18 | 1.715 | 39.75 | 4.73 | 21.04 | 0.468 | 48.75 | 45 |
| | 1 | 2.5 | 20.36 | 90.57 | 2.01 | 16.60 | 6.12 | 27.22 | 0.605 | 21.00 | |
| | 0 | 0 | 24.10 | 107.20 | 2.38 | 12.00 | | | | | |
| 10C | 3 | 7.6 | 7.73 | 34.38 | 0.637 | 39.00 | 2.59 | 11.52 | 0.213 | 52.40 | 54 |
| | 1 | 2.5 | 8.75 | 38.92 | 0.721 | 14.40 | 3.22 | 14.32 | 0.265 | 28.80 | |
| | 0 | 0 | 10.36 | 46.08 | 0.853 | 22.40 | | | | | |
| 11 | 3 | 7.6 | 15.77 | 70.15 | 1.40 | 70.83 | 10.16 | 45.19 | 0.904 | 80.00 | 50 |
| | 1 | 2.5 | 16.21 | 72.11 | 1.44 | 27.40 | 11.65 | 51.82 | 1.036 | 34.00 | |
| | 0 | 0 | 18.05 | 80.29 | 1.61 | 24.60 | | | | | |
| 11C | 3 | 7.6 | 4.09 | 28.19 | 0.371 | 146.40 | 2.53 | 11.25 | 0.230 | 168.00 | 49 |
| | 1 | 2.5 | 4.60 | 20.46 | 0.418 | 59.40 | 2.66 | 11.83 | 0.241 | 71.00 | |
| | 0 | 0 | 5.84 | 25.98 | 0.530 | 42.80 | | | | | |
| 11X | 3 | 7.6 | 18.68 | 83.09 | 1.60 | 45.00 | 9.14 | 40.66 | 0.782 | 42.80 | 52 |
| | 1 | 2.5 | 21.81 | 97.02 | 1.87 | 17.20 | 13.40 | 59.61 | 1.15 | 16.80 | |
| | 0 | 0 | 27.62 | 122.86 | 2.36 | 20.00 | | | | | |
| 12 | 3 | 7.6 | 8.28 | 36.83 | 0.658 | 25.60 | 6.55 | 29.14 | 0.520 | 31.20 | 56 |
| | 1 | 2.5 | 10.91 | 48.53 | 0.867 | 10.83 | 6.83 | 30.38 | 0.543 | 12.60 | |
| | 0 | 0 | 24.56 | 109.25 | 1.951 | 12.60 | | | | | |
| 12C | 3 | 7.6 | 3.98 | 17.70 | 0.334 | 123.20 | 2.88 | 12.81 | 0.242 | 117.60 | 53 |
| | 1 | 2.5 | 4.12 | 18.33 | 0.346 | 51.20 | 3.28 | 14.59 | 0.275 | 52.40 | |
| | 0 | 0 | 4.94 | 21.97 | 0.415 | 18.00 | | | | | |
| 12X | 3 | 7.6 | 3.48 | 15.48 | 0.287 | 19.40 | 3.78 | 16.81 | 0.311 | 24.00 | 54 |
| | 1 | 2.5 | 7.37 | 32.78 | 0.607 | 9.40 | 6.91 | 30.74 | 0.569 | 11.40 | |
| | 0 | 0 | 19.06 | 84.78 | 1.570 | 56.40 | | | | | |

TABLE IV

| | 8 | 8C | 9 | 9C | 11 | 11C |
|---|---|---|---|---|---|---|
| Avg. Tear Force | | | | | | |
| MD(g) | 688 | 164 | 1916 | 680 | 880 | 1016 |
| TD(g) | 832 | 160 | 2084 | 1248 | 2160 | 1884 |
| MD(N) | 6.74 | 1.60 | 18.78 | 6.66 | 8.62 | 9.95 |
| TD(N) | 8.15 | 1.57 | 20.42 | 12.23 | 21.16 | 18.46 |
| Basis Weight $g/m^2$ | 55 | 54 | 51 | 52 | 52 | 49 |
| Avg. Tear Force Per Unit of Basis Weight | | | | | | |
| MD ($N/g/m^2$) | 0.122 | 0.03 | 0.37 | 0.13 | 0.166 | 0.203 |
| TD ($N/g/m^2$) | 0.148 | 0.029 | 0.400 | 0.23 | 0.407 | 0.377 |

TABLE V-continued

| Example No. | 13 | 14 & 15 | 16 |
|---|---|---|---|
| (kPa) | 138 | 172 | 172 |
| Temperature (° C.) | 200 | 310 | 310 |
| Orienting Chamber | | | |
| Pressure (PSI) | 70 | 70 | 70 |
| (kPa) | 483 | 483 | 483 |
| Temperature (° C.) | ambient | ambient | ambient |
| Rate of Polymer Extrusion | | | |
| (lb/hr/in) | 0.5 | 1 | 1 |
| (g/hr/cm) | 89 | 178 | 178 |

TABLE VI

| | Initial Measurement | | After 10 Washes | | Percent Loss | |
|---|---|---|---|---|---|---|
| Property Tested | Example 13 | Example 13C | Example 13 | Example 13C | Example 13 | Example 13C |
| Insulating Efficiency (clo) | 2.583 | 2.50 | 1.972 | 1.65 | 24 | 35 |
| Web Thickness (cm) | 1.37 | 1.4 | 1.12 | 0.98 | 18 | 30 |
| Web Weight ($g/m^2$) | 144 | 220 | | | | |
| Insulating Efficiency Per Unit of Thickness (clo/cm) | 1.88 | 1.78 | 1.76 | 1.66 | 6 | 7 |
| Insulating Efficiency Per Unit of Weight (clo/kg) | 17.9 | 11.4 | | | | |

EXAMPLE 13

As an illustration of a useful insulating web of the invention, a web was made comprising 65 weight-percent oriented melt-blown polypropylene microfibers made according to Example 1 (see Table V below for the specific conditions), and 35 weight-percent 6-denier crimped 1-¼ inch (3.2 cm) polyethylene terephthalate staple fibers. The web was prepared by picking the crimped staple fiber with a licker in roll (using apparatus as taught in U.S. Pat. No. 4,118,531) and introducing the picked staple fibers into the stream of oriented melt-blown fibers as the latter exited from the orienting chamber. The diameter of the microfibers was measured by SEM and found to range between 3 and 10 microns, with a mean diameter of 5.5 microns. The web had a very soft hand and draped readily when supported or an upright support such as a bottle.

For comparison, a similar web (13C) was prepared comprising the same crimped staple polyethylene terephthalate fibers and polypropylene microfibers prepared like the microfibers in the webs of the invention except that they did not pass through an orienting chamber.

Thermal insulating values were measured on the two webs before and after 10 washes in a Maytag clothes washer, and the results are given in Table VI.

TABLE V

| Example No. | 13 | 14 & 15 | 16 |
|---|---|---|---|
| Die Temperature (° C.) | 200 | 310 | 310 |
| Primary Air | | | |
| Pressure (PSI) | 20 | 25 | 25 |

EXAMPLE 14–15

Insulating webs of the invention were prepared which comprised 80 weight-percent oriented microfibers of polycyclohexane terephthalate (crystalline melting point 295° C.; Eastman Chemical Corp. 3879), made on apparatus as described in Example 2 using conditions as described in Table V, and 20 weight-percent 6-denier polyethylene terephthalate crimped staple fiber introduced into the stream of melt-blown oriented fibers in the manner described for Example 13. Two different webs of excellent drapability and soft hand were prepared having the basis weight described below in Table VII. Thermal insulating properties for the two webs are also given in Table VII.

TABLE VII

| Example No. | 14 | 15 | 16 |
|---|---|---|---|
| Weight ($g/m^2$) | 133 | 106 | 150 |
| Thickness (cm) | 0.73 | 0.71 | |
| Insulating Efficiency (clo) | 1.31 | 1.59 | |
| (clo/cm) | 1.79 | 2.24 | 1.63 |
| (clo-$m^2$/kg) | 9.8 | 15.0 | 13.9 |
| After Washed 10 Times | | | |
| Insulating Efficiency % Retained | 103.1 | 92.2 | 99.6 |
| Thickness (% Retained) | 97.3 | 98.6 | |

EXAMPLE 16

An insulating web of the invention was made comprising 65 weight-percent oriented melt-blown polycyclohexane terephthalate microfibers (Eastman 3879) and 35 weight-percent 6-denier polyethylene terephthalate crimped staple fibers. Conditions for manufacture of the oriented melt-blown microfibers are as given in Table V, and measured properties were as given in Table VII. The web was of excellent drapability and soft hand.

EXAMPLE 17 and 18

A first web of the invention (Example 17) was prepared according to Example 1, except that two dies were used as shown in FIG. 2. For the die 10A, the die temperature was 200° C., the primary air temperature and pressure were 200° C. and 15 PSI (103 kPa), respectively, and the orienting chamber air temperature and pressure were ambient temperature and 70 PSI (483 kPa), respectively. Polymer throughput rate was 0.5 lb/hr/in (89 g/hr/cm). The fibers leaving the orienting chamber were mixed with non-oriented melt-blown polypropylene fibers prepared in the die 10*b*. For die 10B, the die temperature was 270° C., and the primary air pressure and temperature were 30 PSI (206 kPa) and 270° C., respectively. The polymer throughput rate was 0.5 lb/hr/in (89 g/hr/cm).

As a comparison, another web of the invention (Example 18) was prepared in the manner of Example 4, which comprised only oriented melt-blown fibers. Both the Example 17 and 18 webs were embossed at a rate of 18 feet per minute in a spot pattern (diamond-shaped spots about 0.54 square millimeters in area and occupying about 34 percent of the total area of the web) using a temperature of 275° F. (135° C.), and a pressure of 20 PSI (138 kPa).

Both the Example 17 and 18 embossed webs were measured on an Instron tester for tensile strength versus strain in the machine direction, i.e., the direction of movement of the collector, and the cross direction, and the results are reported below in Table VIII.

TABLE VIII

| | MD | | | | CD | | | |
|---|---|---|---|---|---|---|---|---|
| | | | | Example 17 | | | | |
| Stress | | | | | | | | |
| (PSI) | 1600 | 2400 | 2700 | 2950 | 1600 | 2350 | 2650 | 2850 |
| (kPa) | 11008 | 16512 | 18576 | 20296 | 11008 | 16168 | 18232 | 19608 |
| Strain % | 6 | 12 | 18 | 24 | 6 | 12 | 18 | 24 |
| | | | | Example 18 | | | | |
| Stress | | | | | | | | |
| (PSI) | 2900 | 4000 | 4700 | 4500 | 550 | 750 | 925 | 1075 |
| (kPa) | 19952 | 27520 | 32336 | 31023 | 3784 | 5160 | 6364 | 7396 |
| Strain % | 6 | 12 | 18 | 24 | 6 | 12 | 18 | 24 |

EXAMPLE 19

Using the apparatus of FIG. 2A without the secondary chamber 38, a ultrafine submicron fiber was blown from polypropylene resin (Himont Pf442) the extruder temperature was 435° F. (224° C.) and the die temperature was 430° F. (221° C.). The extruder operated at 5 RPM (¾ inch diameter, model No. D-31-T, C. W. Brabender Intruments of Hackensack, N.J.) with a purge block. Excess polymer was purged in order to approximate a polymer flow rate of less than 1 gm/orifice/hr. The die had 98 orifices, each with an orifice size of about 0.005 inches (125 micrometers) and an orifice length of 0.227 inches (0.57 cm). The primary air pressure was 30 PSI (206 kPa) and a gap width of 0.01 in (0.025 cm). The primary air temperature was 200° C. The polymer was blown into the orienting chamber. The secondary orienting air had a pressure of 70 PSI (483 kPa) with an air gap width of 0.03 inches and was at ambient temperature. The Coanda surface had a radius of ⅛ in (0.32 cm). The chamber had an interior height of 1.0 inches (2.54 cm), an interior width of 4 inches (10.16 cm), and a total length of 20 inches (including a flared exit portion).

The fibers formed had an average fiber diameter of 0.6 micrometers with 52% of the fibers in the range of 0.6 to 0.75 micrometers. Approximately 85% of the fibers were in the range of 0.45 to 0.75 micrometers. (The fiber sizes and distributions were determined by scanning electron micrographs of the web analyzed by an Omicon™ Image Analysis System made by Bausch & Lomb.) Some roping of fibers (approximately 3%) was noted.

EXAMPLE 20

This example again used the apparatus and polymer of Example 19 without the chamber 38. In this example, the chamber 37 was provided with sidewalls formed of porous glass and had a chamber length of 15½ inches excluding the flared exit portion. The air knives on the chamber 37 were also adjustable to allow the air to be delivered to the Coanda surface at different angles. The Coanda surface had a radius of 1 in (2.54 cm) and an air exit angle of 45 degrees. The temperature of the extruder ranged from 190 to 255° C. from inlet to outlet and rotated at 4 rotations per minutes (a 0.75 in, 1.7 cm screw diameter). A purge block was again used to keep the polymer flow rate down and prevent excessive residence time of the polymer in the die. The polymer flow rate was 260 gm/hr (2.6 g/min/orifice). The die temperature was 186° C. and had orifices each with an orifice size of 0.005 in (0.013 cm). The primary air pressure was 10 PSI (70 kPa) with an air gap width of 0.005 in (0.013 cm). The secondary orienting air had a pressure of 20 PSI (140 kPa) with an air gap width of 0.03 in (0.0076 cm). Cooling air was introduced through the porous glass walls at a pressure of 10 PSI (70 kPa). The collector was located 22 in (56 cm) from the die. The fibers under microscope appeared to have an average diameter of one micrometer.

EXAMPLES 21–34

The set-up and polymer was used as in Example 19 above. The conditions of the process are set forth in Table IX below.

TABLE IX

| Ex | T1 | T2 | T3 | $T_{a1}$ | $T_{a2}$ | $P_{a1}$ | $P_{a2}$ | $R^1$ | $T_m$ |
|---|---|---|---|---|---|---|---|---|---|
| 21 | 240 | 250 | 250 | 230 | 25 | 50 | 80 | 2 | 180 |
| 22 | 240 | 250 | 250 | 230 | 25 | 30 | 80 | 15 | 179 |
| 23 | 240 | 250 | 250 | 230 | 25 | 23 | 80 | 10 | 180 |
| 24 | 240 | 250 | 250 | 230 | 25 | 50 | 80 | 4 | 180 |
| 25 | 240 | 250 | 250 | 230 | 25 | 10 | 20 | 2 | 180 |
| 26 | 240 | 250 | 250 | 230 | 25 | 10 | 10 | 2 | 177 |
| 27 | 240 | 250 | 250 | 230 | 25 | 15 | 5 | 2 | 180 |
| 28 | 240 | 250 | 250 | 230 | 25 | 35 | 5 | 2 | 180 |
| 29 | 240 | 250 | 250 | 230 | 25 | 35 | 25 | 2 | 177 |
| 30 | 240 | 250 | 250 | 230 | 25 | 35 | 5 | 2 | 180 |
| 31 | 240 | 250 | 250 | 230 | 25 | 30 | 50 | 2 | 180 |
| 32 | 240 | 250 | 250 | 230 | 25 | 20 | 50 | 2 | 177 |
| 33 | 240 | 250 | 250 | 230 | 25 | 5 | 50 | 2 | 177 |

$T_1$ extruder exit temperature (° C.)
$T_2$ purge block temperature (° C.)
$T_3$ temperature of the die (° C.)
$T_{a1}$-$T_{a2}$ temperature of the airstreams (° C.), the primary air and the first orienting air, respectively.
$P_{a1}$-$P_{a2}$ the pressures of the above airstreams (PSI).
$F_1$ polymer flow rate was approximately 2.5 gm/hr/orifice, for Examples 31–33.
$R^1$ extruder RPM
$T_m$ temperature of melt (° C.)

The fiber size (in micrometers) distribution was then determined with the results set forth in Table X below.

TABLE X

| Ex. | Mean | Median | St.Dev. | 90% + range | Ct |
|---|---|---|---|---|---|
| 21 | 2.7 | 2.8 | 0.6 | 1.5–3.5 | 15 |
| 22 | 4.8 | 4.6 | 2.4 | 0.1–8.1 | 16 |
| 23 | 2.2 | 2.1 | 1.4 | 0.5–4.5 | 21 |
| 24 | 2.7 | 2.7 | 0.6 | 2.1–3.7 | 13 |
| 25 | 1.7 | 1.7 | 0.3 | 1.4–2.2 | 15 |
| 26 | 2.0 | 2.0 | 0.5 | 1.5–3.5 | 22 |
| 27 | 2.6 | 2.5 | 0.4 | 1.6–3.4 | 19 |
| 28 | 2.5 | 2.3 | 1.0 | 1.0–4.0 | 28 |
| 29 | 2.4 | 2.4 | 0.6 | 1.0–4.0 | 20 |
| 30 | 2.5 | 2.6 | 0.4 | 1.7–3.8 | 20 |
| 31 | 0.93 | 0.82 | 0.38 | 0.6–1.6 | 37 |
| 32 | 0.80 | 0.81 | 0.25 | 0.3–1.2 | 101 |
| 33 | 0.90 | 0.85 | 0.07 | 0.78–0.92 | 100 |

In Table X, the 90% range is the size range in which 90%, or more, of the fibers are found, Ct is the number of fibers measured, and St.Dev. represents the standard deviation. Generally, narrower size distributions were noted with lower polymer flow rates. Examples 22 and 23 had higher extruder speeds and a significantly wider range of fiber diameters compared to Examples 21 and 24.

The last three examples in Table X (31–33) have smaller mean diameters than the other examples. It is believed that this arose form the combination of relatively lower primary pressure and relatively higher air pressure from the orientation chamber orifices.

Figure 13:
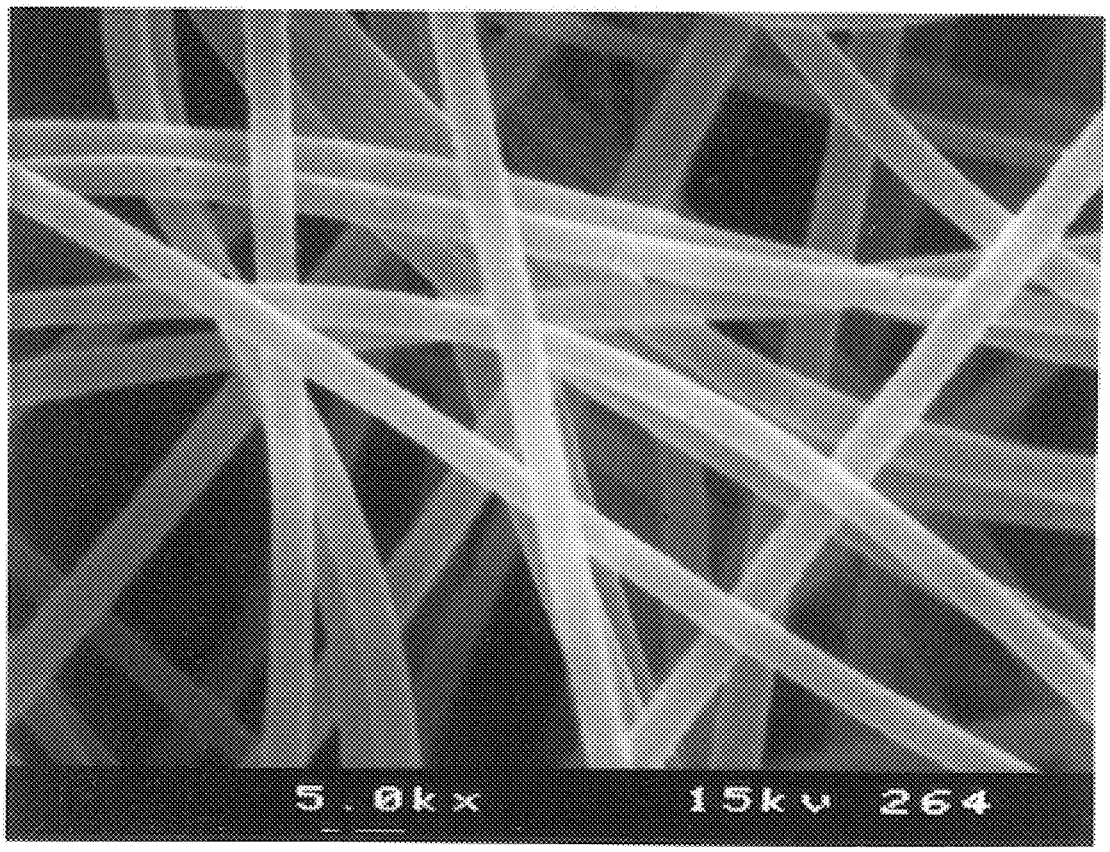
FIG. 13 is a scanning electron micrograph of the submicron fibers of Example 33.

Example 33 yielded extremely small average diameter fibers of a very narrow range of fiber diameters. The scanning electron micrograph of the Example 33 fibers of FIG. 13 shows this uniformity of fiber sizes (the small line below "5.0 kx" represents 1 micrometer).

EXAMPLE 34

In this example, the same arrangement and polymer were used, as in Example 20, except that a secondary chamber 38 (namely, that used in Example 19) was used. The extruder and a ratio of metering pumps were used to control the purge block. The extruder outlet temperature was 240° C. and the purge block and die were 250° C. The extruder was run at 2 RPMs.

The action of purge block was controlled by three precision pumps (pump 1, "Zenith" pump, model no. HPB-4647-0.297, pumps 2 and 3, "Zenith" pumps, model no. HPB-4647-0.160, obtained from the Powell Equipment Company, Minneapolis, Minn.). Pumps 1 and 2 were driven by a precision, adjustable, constant speed motor (model number 5BP56KAA62, Boston Gear Company, of Boston, Mass.). These pumps were connected by a full-time gear drive which drove pump 1 at five times the speed of pump 2. Pump 3 was driven by another precision speed motor of the same type. These pumps divided the onflowing stream of resin into two streams. The larger polymer stream from pump 3 was removed ("purged") from the system. The smaller stream from pump 2 was retained.

The smaller stream was passed through a filter bed of small glass beads with a mesh of 240 holes/in$^2$, capable of removing any foreign matter larger than 1 micron (1 micrometer). It was then conveyed into the die and extruded through the orifices (0.012 inches diameter, 0.03 cm).

Primary air ("Air 1") was supplied to the die, at a controlled temperature (210° C.), pressure (5 PSI with an air gap of 0.01in), and volume per unit time.

Before beginning the actual formation and collection of the fibers of the invention, the flow rate of the polymer through the die was measured by collecting samples of the emergent resin stream at a point just beyond the die by placing a small weighted piece of mesh/screen at that point. After five minutes, the screen was re-weighted, the weight of resin collected and the extrusion rate in grams/hole/minute were calculated.

After making this measurement, the resin stream was routed through two separate chambers.

The first orienting airstream was used to carry the stream of melted-but-cooling resin on through the first chamber. The pressure of the orienting air was 10 PSI (70 kPa) with an air gap of 0.03 in (0.0076 cm). Air was also introduced at 5 PSI (35 kPa) through the porous sidewalls of the chamber.

The fibers were then intercepted by a second orienting chamber 38, when they were substantially or completely cooled, this orienting chamber had an orienting airstream at 60 PSI (412 kPa) with an air gap of 0.03 in (0.0076 cm) and an entangling airstream adjacent the chamber exit introduced through apperatures, at 5 PSI (35 kPa). Pump 1 (31 in FIG. 2A) was operated at 1730 RPMs with pump 2 (32 in FIG. 2A) was driven at one-fifth this speed with pump 3 (33 in FIG. 2A) operating at approximately 900 RPM at steady state. The polymer feed rate was 1 gm/hr/orifice. The fiber formed had a mean diameter of 1.1 micrometers with all fibers (6 counted) in the range of 0.07 to 1.52 micrometers.

As a matter of comparison, this same polymer was blown without either chamber (37 or 38 of FIG. 2A). All conditions in the remaining steps of the melt-blown process were identical with the exception of the primary air pressure, which was increased to 10 PSI (70 kPa). The fibers collected had an average fiber size of 1.41 micrometers with a standard deviation of 0.37 micrometers. All fibers lay in the range of 0.5 to 2.1 micrometers.

In further comparison, see Example 1 where much higher polymer blown rates were used (89 gm/hr/orifice). This condition resulted in a much wider range of fiber diameters for both the oriented and unoriented melt-blown fibers.

EXAMPLE 35

This example was run in accordance with the procedure and apparatus of example 34. The polymer was a polyethylene (Dow Aspun™ 6806, available from Dow Chemical Co., Midland, Mich.). The extruder was run at 3 RPMs with an exit temperature of about 200° C. The die block and purge block were also about 200° C. The gear pump 1 was run at 1616 RPMs with gear pump 3 operating at 1017 RPM's. The polymer feed rate was about 1.0 gm/hr/orifice.

The primary air temperature and the melt temperature were both 162° C. The air pressure was of the primary air was 6 PSI (32 kPa). The orienting air in chamber 37 was 50 PSI (345 kPa) (room temperature) with an 0.01 in (0.025 cm) gap width and the cooling air was at 10 PSI (70 kPa). The second chamber had orienting air at 50 PSI (345 kPa) and an entangling airstream at 10 PSI (70 kPa). The mean fiber diameter was 1.31 micrometers with a standard deviation of (0.49 micrometers) (12 samples). All the fibers lay in the size range of 0.76 to 2.94 micrometers, 94 percent were between 0.76 and 2.0 micrometers. The die had 56 orifices, each 0.012 in (0.03 cm).

EXAMPLE 36

The polymer of Example 35 was run as per Example 34 above with a polymer feed rate of 0.992 gm/hr/orifice (gear pump 31, gear pump 33, and extruder RPM's of 1670, 922 and 3, respectively). The primary air (170° C.) was at 10 PSI (70 kPa) with an air gap width of 0.01 in (0.025 cm). The melt temperature was 140° C. extruded from a die at 200° C. (the extruder exit temperature and block temperature were about 170° C.). The unoriented fibers formed had a mean fiber diameter of 4.5 micrometers and a standard deviation of 1.8 micrometers. 93 percent of the fibers were found in the range of 2 to 8 micrometers (47 fibers sampled).

For comparison, the polyethylene fibers of Example 3 had approximately the same fiber size distribution when unoriented, but a much wider fiber size distribution when oriented compared to Example 35.

EXAMPLES 37 and 38

These examples were run in accordance with the procedure of the previous example. The polymer used was nylon (BASF KR-4405) using a die insert with 0.005 in (0.013 cm) and 0.012 (0.03 cm) in diameter orifices for the unoriented and the oriented examples, respectively. The extruder was run at 2 and 20 RPM, respectively, with exit temperatures of 310 and 300° C., respectively. The die and feed block temperatures were 280 and 270° C., and 275 and 270° C., respectively. The gear pumps 31 and 33 were run at 1300 and 1330 RPM'S, respectively. The melt temperatures were 231 and 234° C., respectively, with a primary air temperature of 242 and 249° C., respectively. Example 37 was unoriented using only the primary air at 7 $ft^3$/min (0.2 $m^3$/min) with an air gap of 0.01 in (0.025 cm). The resulting fibers had a mean diameter of 1.4 micrometers with a standard deviation of 1.0. 95 percent of the fibers (62 counted) had fibers in the range of 0.0 to 3.0 micrometers. In comparison, see Example 2, where for a higher polymer flow rate, a much wider range of fiber diameters were obtained.

Example 38 was oriented using a primary air at 3.5 $ft^3$/min (10 SI or 70 kPa with a 0.01 in (0.025 cm) air gap). The first chamber 37 had orienting air at 20 PSI (140 kPa) and sidewall air at 5 PSI (35 kPa). The second orienting chamber had air at 40 PSI(277 kPa) and entangling air at 5 PSI (35 kPa). The resulting fibers had a mean diameter of 1.9 micrometers with a standard deviation of 0.66 micrometers. 91.6 percent of the fibers (24 counted) had diameters within the range of 1.0 to 3.0 micrometers.

The above examples are for illustrative purposes only. The various modifications and alterations of this invention will be apparent to those skilled in the art without departing from the scope and spirit of the invention, and this invention should not be restricted to that set forth therein for illustrative purposes.

We claim:

1. A non-woven substantially shot-free fabric comprised of oriented, substantially continuous, melt-blown fibers wherein the mean diameter of the melt-blown fibers of the non-woven fabric is less than about 10 micrometers and at least 90 percent of the melt-blown fibers of the non-woven fabric have individual fiber diameters that are in a fiber diameter size range of less than about 3 micrometers, which size range includes the mean fiber diameter.

2. The non-woven fabric of claim 1 wherein the mean diameter of the melt-blown fibers is less than about 5 micrometers and at least 90 percent of the fibers have individual fiber diameters that are in a fiber diameter size range of less than about 2 micrometers, which size range includes the mean fiber diameter.

3. The non-woven fabric of claim 2 wherein the mean diameter of the melt-blown fibers is less than 2 micrometers.

4. The non-woven fabric of claim 3 wherein at least 90 percent of the individual fiber diameters of the melt-blown fibers of the non-woven fabric are within a fiber diameter size range of about 1 micrometer or less.

5. The non-woven fabric of claim 1 further comprising crimped staple fibers blended with the melt-blown fibers.

6. The non-woven fabric of claim 1 wherein the melt-blown fibers have a crystalline axial orientation function of at least 0.65.

7. The non-woven fabric of claim 1 wherein the melt-blown fibers have a crystalline axial orientation function of at least 0.8.

8. The non-woven fabric of claim 1 comprising a bonded web having a minimum machine-direction grab tensile strength to weight ratio greater than 1.5 Newton per gram per square meter, and having a minimum machine direction Elmendorf tear strength to weight ratio greater than 0.1 Newton per gram per square meter.

9. The non-woven fabric of claim 8 in which the web of fibers is bonded by being thermally embossed at intermittent discrete bond regions which occupy between 5 and 40 percent of the area of the fabric.

10. The non-woven fabric of claim 1 comprising a bonded web having a minimum machine-direction grab tensile strength to weight ratio greater than 2.5 Newton per gram per square meter, and having a minimum machine-direction Elmendorf tear strength to weight ratio greater than 0.25 Newton per gram per square meter.

* * * * *